US006752043B2

(12) United States Patent
Carlson

(10) Patent No.: US 6,752,043 B2
(45) Date of Patent: Jun. 22, 2004

(54) VISE APPARATUS

(75) Inventor: Robin W. Carlson, Pella, IA (US)

(73) Assignee: Vermeer Manufacturing Company, Pella, IA (US)

( * ) Notice: Subject to any disclaimer, the term of this patent is extended or adjusted under 35 U.S.C. 154(b) by 0 days.

(21) Appl. No.: 10/218,478

(22) Filed: Aug. 13, 2002

(65) Prior Publication Data

US 2003/0056623 A1 Mar. 27, 2003

Related U.S. Application Data

(60) Provisional application No. 60/324,396, filed on Sep. 24, 2001.

(51) Int. Cl.[7] ..... B25B 17/00

(52) U.S. Cl. ..... 81/57.16; 81/57.15; 81/57.2; 81/57.24; 81/57.33; 81/57.34

(58) Field of Search ..... 81/57.15, 57.16, 81/57.2, 57.24, 57.33, 57.34, 57.35, 57.4

(56) References Cited

U.S. PATENT DOCUMENTS 3,902,385 A 9/1975 Haby ..... 81/57.34
3,921,473 A * 11/1975 Boyadjieff et al. ..... 81/57.34
4,005,621 A * 2/1977 Turner et al. ..... 81/57.2
4,023,449 A 5/1977 Boyadjieff ..... 81/57.16
4,082,017 A * 4/1978 Eckel ..... 81/57.16
4,092,881 A * 6/1978 Jurgens et al. ..... 81/57.34
4,290,304 A * 9/1981 Eckel ..... 73/862.25
4,619,159 A * 10/1986 Kurek ..... 81/57.34
5,740,703 A 4/1998 Perry ..... 81/57.35
5,758,553 A 6/1998 Perry ..... 81/57.34
6,164,165 A * 12/2000 Browning et al. ..... 81/57.34

* cited by examiner

*Primary Examiner*—Joseph J. Hail, III
*Assistant Examiner*—Alvin J Grant
(74) *Attorney, Agent, or Firm*—Merchant & Gould P.C.

(57) ABSTRACT

A vise apparatus for use on a drilling machine to thread together pipe to form a drill string. The vise apparatus also for use on a drilling machine to break pipe threaded together in a drill string. The vise apparatus having scissor members that open to receive various size pipe diameters and close to contact the pipe around the pipe diameter at equally distanced locations.

21 Claims, 28 Drawing Sheets

VISE APPARATUS

CROSS-REFERENCE TO RELATED APPLICATIONS

This application claims the benefit of a U.S. Provisional Application filed on Sep. 24, 2001 having Serial No. 60/324,396, the Provisional Application Serial No. 60/324,396 being herein incorporated by reference.

FIELD OF TECHNOLOGY

The present invention relates generally to horizontal underground drilling machines. More particularly, the present invention relates to a vise apparatus used with threaded drill pipe.

BACKGROUND OF THE INVENTION

A variety of vise arrangements for use with horizontal drilling machines exist, including vise jaws having two opposing jaw halves. The jaws are arranged to clamp onto a pipe to either thread or unthread the pipe to another pipe. The vise jaws are clamped to the pipe by hydraulic actuators or cylinders that provide engagement or clamping force.

In conventional jaw designs, the maximum torque applied to the gripped pipe, without relative movement between the pipe and the jaws, is directly proportional to the force applied by hydraulic cylinders. The torque effected on the pipe provides torque holding capacity at a threaded connection between the two pipes. Larger pipes require greater torque to effect sufficient torque holding capacity. The drill pipe used in conjunction with the conventional jaw design is limited, typically ranging from 1½ to 3½ inches in outer diameter.

Drilling machines utilizing much larger drill pipe and drill tools are becoming available for use in the industry. For example, some drill pipe can range up to about 8 inches in outer diameter. A design that provides greater engagement force to effect sufficient torque holding capacity at a threaded connection between larger pipes is needed.

Conventional designs incorporating a latch door arrangement for use on vertical drilling machines have been used to provide sufficient engagement force on larger diameter pipes. These designs, however, are particular to vertical drilling rigs wherein there is ample space in the vicinity of the latch door vise arrangement. A vise apparatus that accommodates large pipe is needed for use on a horizontal drilling machine where space between the ground and a ground support is limited.

SUMMARY OF THE INVENTION

The disclosure describes a vise apparatus for use on a horizontal drilling machine. In one embodiment the vise apparatus includes at least one vise mechanism having scissor members. In another embodiment, the vise apparatus may include two vise mechanisms, each having scissor members.

In the preferred embodiment of the vise mechanisms, the scissor members are components of a linkage arrangement that contacts a clamped element at four locations.

Another aspect of this disclosure involves a vise apparatus that is positionable. In the preferred embodiment, the vise apparatus may be capable of longitudinal translation along rails of a rack assembly. In an embodiment having two vise mechanisms, the second vise mechanism may, in addition, be longitudinally translated along the rails in relation to the first vise mechanism.

DETAILED DESCRIPTION OF THE INVENTION

Figure 1:
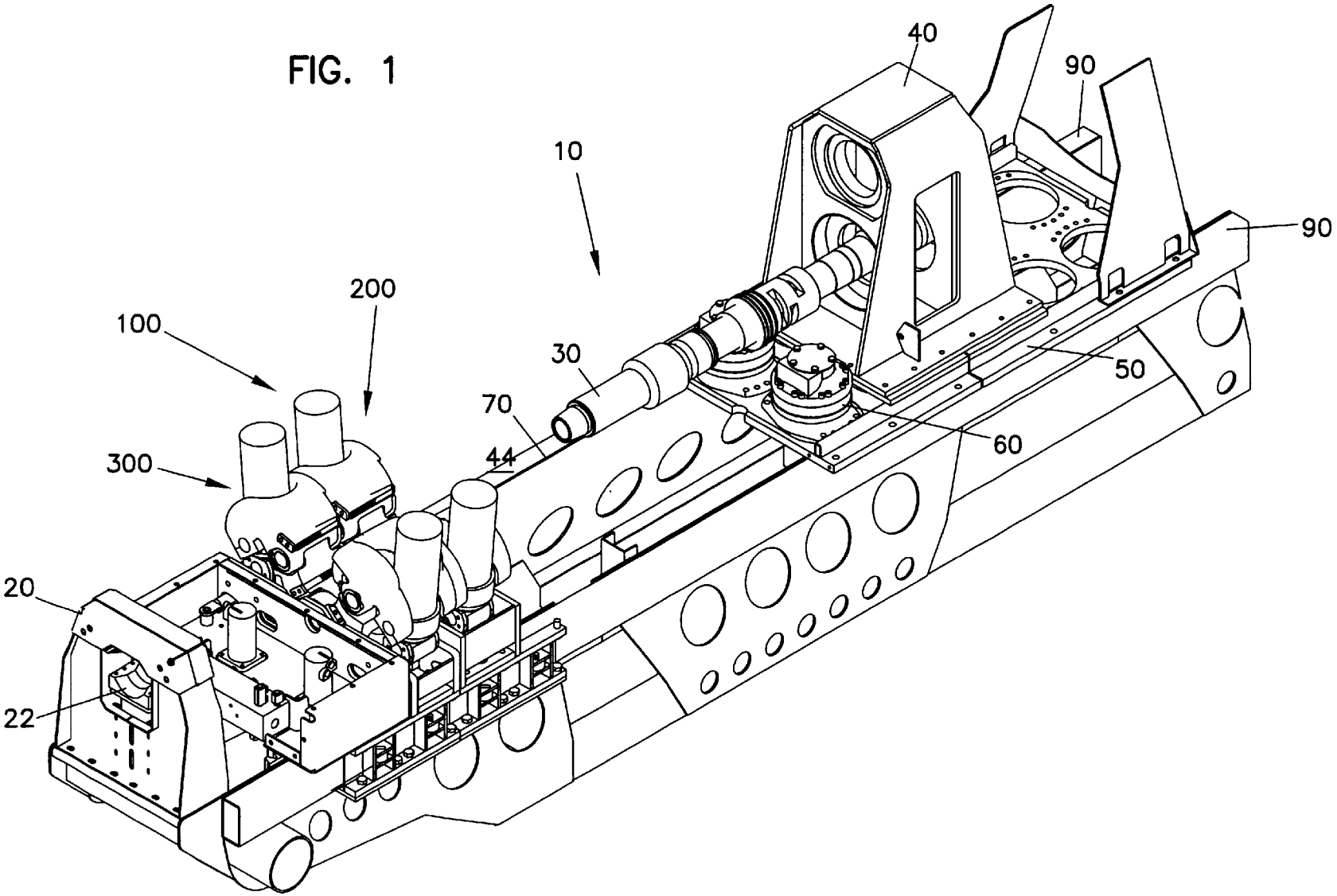
FIG. 1 is a front perspective view of a rack assembly for use on a horizontal directional drilling machine in accordance with the principles of this disclosure.

With reference now to the various figures in which identical elements are numbered identically throughout, a description of various exemplary aspects of the present invention will now be provided.

I. General Operation of the Vise Apparatus in Horizontal Drilling

The present invention is directed to a vise apparatus for use on horizontal drilling machines. Horizontal drilling machines typically comprise a rotational drive mechanism, a longitudinal drive mechanism, a vise apparatus, a ground support, and a drill pipe storage/transfer apparatus. The drilling process involves threading together lengths of threaded drill pipe to form a drill string extending from the drilling machine though a bored hole and terminating at a drill bit assembly. The drill string transfers rotational torque and longitudinal thrust from the drive mechanisms to the drill bit assembly.

To begin drilling a bore, the drill bit assembly is located near the ground support of the horizontal drilling machine and is attached to a drill string. The drill string initially comprises a first drill pipe that is attached to the rotational drive mechanism and longitudinal drive mechanism. The rotational drive mechanism and longitudinal drive mechanism are typically located at an end opposite the bore location. The first step of boring is thus to attach the drill bit assembly to the first drill pipe.

The drill bit assembly is generally larger in diameter than the drill pipe. Conventional designs require that the drill bit assembly be connected to the first drill pipe by manual wrenching. It would be beneficial to connect the drill bit assembly to the first drill pipe by inserting the drill bit assembly into a vise apparatus to aid in the preparations of drilling the bore. The vise apparatus according to the principles of this disclosure provide such utility in an open dimension or adaptable configuration that permits drill bit assemblies to be inserted and clamped into the vise apparatus, as will be described later in detail.

Once the drill bit assembly is connected to the first drill pipe, the drill string (the drill bit assembly and the first drill pipe) are rotated and propelled into the ground. As the drill string progresses, a second drill pipe is removed from the storage/transfer apparatus and positioned in alignment with the drill string. Typically the storage/transfer apparatus comprises a magazine wherein the longitudinal axis of the stored drill pipe is parallel to the drill string. Once positioned, the second drill pipe is threaded to the drill string. The process is repeated to extend the length of the bored hole.

The drill string is subjected to high torque loads. In directionally controlled applications, the drill string is also subjected to significant bending loads. Proper mating of threaded joints between the drill pipes is critical to the performance of the drill string. To properly "make-up" the threaded joints, significant torque loads must be applied to the outer diameters of the drill pipes.

When the bored hole is as long as desired, the drill bit assembly is often changed; or, for a variety of reasons, the drill string is removed from the bored hole. In the latter case, for example, the fixed lengths of drill pipes are subsequently pulled out of the bored hole, unthreaded, and transferred back to storage. Removal of the drill string involves "break-out" of the threaded connections or joints. The break-out torque necessary to break the threaded connection is generally similar or greater than the torque required to initially make-up the threaded joint.

Vise configurations of conventional designs involve a lower clamp, an upper clamp, and a driver. The driver is a part of the drilling machine that is longitudinally propelled, typically along a track, and has a male threaded end, or pin end. In make-up operations, the driver advances the drill string along a longitudinal axis until the driver reaches an end of the track. At that point, the lower clamp secures the drill string in a stationary position. The driver rotationally reverses to unthread from a box end (or female threaded area) of the drill string while reversing longitudinally along the track. A new drill pipe is positioned within a loading area either manually or with a rod loader mechanism. The driver changes rotational direction and begins to again longitudinally advance along the track toward the new drill pipe. The pin end of the driver engages a box end (i.e. female threaded-end) of the new drill pipe. As the driver continues to advance longitudinally, a pin end of the new drill pipe engages the box end of the clamped drill string and repeats the process.

As a wider variety of tools used in horizontal drilling become available, the need to adapt the vise apparatus to accommodate the various shapes and sizes of tools becomes more important. For instance, some applications insert a relatively short pipe section having the same diameter as the final bored hole into a section of the bored hole to stabilize the soil. This pipe section is commonly known as a slip lining. Because the slip lining has a diameter larger than the diameter of the drill string, the slip lining is typically difficult or impossible to fit within the vise apparatus of conventional designs.

Another consideration with regards horizontal drilling concerns the overall arrangement of the drilling machine and vise apparatus in relation to ground. Placement of the drilling machine such that the vise apparatus is as close to the entrance of the bored hole as possible is important to provide maximum support of the drill string. Thus, the opening diameter and the overall envelope of the vise apparatus must ideally accommodate installation of slip lining having a large diameter, yet must be sized for placement that provides drill string support. The vise apparatus according to the principles of this disclosure provides such a feature wherein the design minimizes the cross-sectional size of the overall apparatus assembly while maximizing the opening diameter, as will be described later in detail.

In general, the horizontal drilling machine as described by this disclosure comprises of a main chassis assembly having a ground engaging device, tracks, an engine and hydraulic drive unit, an operator's station, and a main frame. The main chassis assembly of the horizontal drilling machine generally comprises a rack assembly having some type of rod loading and handling device, or pipe magazine. Theses devices ranges from basic transfer mechanisms such as various types of hoists or slings to highly specialized mechanized units specifically designed to manipulate specific rods.

Figure 2:
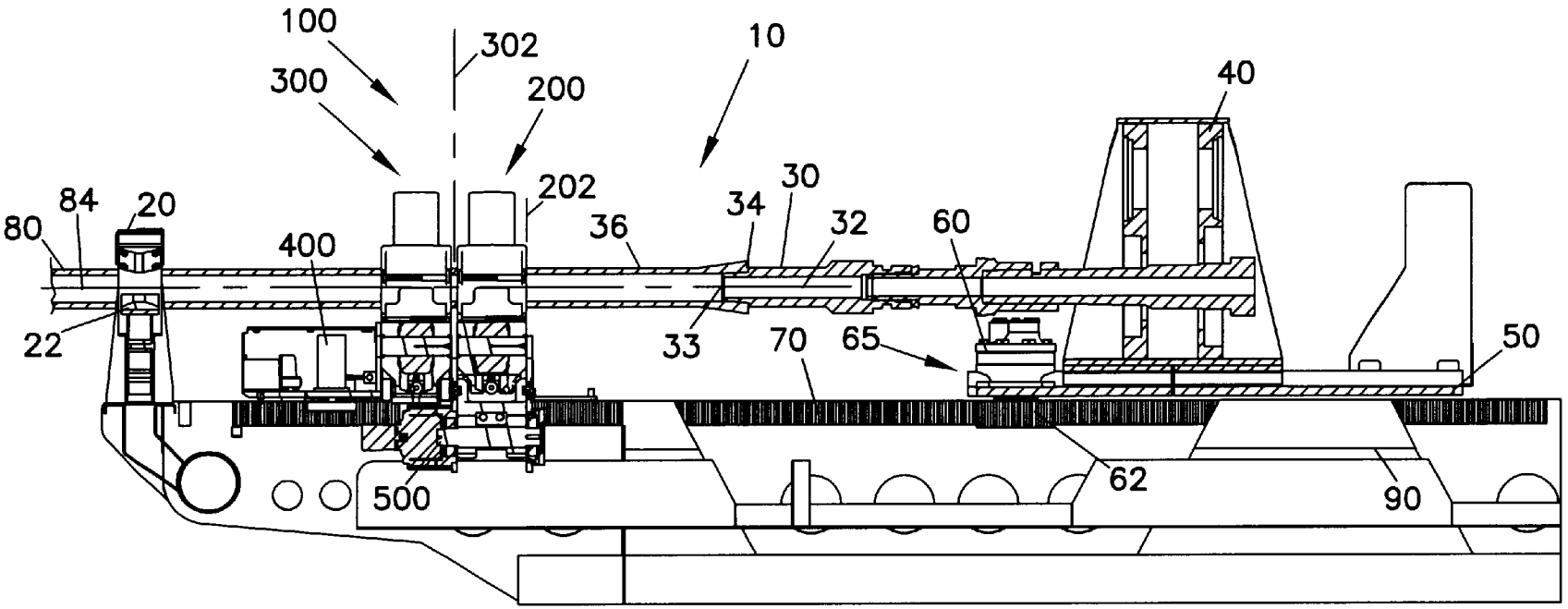
FIG. 2 is a side view of the rack assembly of FIG. 1.

Referring to FIGS. 1 and 2, a rack assembly 10, (shown without a pipe magazine) is illustrated. The rack assembly 10 is mounted to a chassis assembly (not shown) of a horizontal drilling machine. The rack assembly 10 comprises a vise apparatus 100. The vise apparatus 100 according to the principles disclosed could be applied to a variety of machines that utilize clamping devices.

FIG. 2 is a side view of the rack assembly 10 and illustrates components that manipulate a drill rod, tube or pipe 36. The rack assembly 10 includes a front centering assembly 20, the vise apparatus 100, and a spindle 30 coupled to a rotational gearbox 40. The rotational gearbox 40 is mounted to a thrust frame 50 onto which thrust motors 60 are mounted. The trust motors 60 rotationally drive pinion gears 62 that engage rack gears 70. The resulting rack and pinion gear drive 65 propels the thrust frame 50 forward and backward along rack rails 90 of the rack assembly 10. The thrust frame 50 therein propels the spindle 30 and the drill string 80 longitudinally, while at the same time the rotational gearbox 40 rotates the drill string 80. In the alternative, the rack and pinion gear drive 65 may be replaced by cylinder and chain mechanisms or straight cylinder mechanisms to provide longitudinal force to the drill string 80.

The vise apparatus 100 further includes a rotating vise assembly 200, a fixed vise assembly 300, a longitudinal positioner 400, and a rotational vise driver 500. These components function to operate drilling processes such as, for example, starting and extending the drill string, known as performing the pilot bore process, and retracting the drill string, known as pull-back.

II. Operation of the Vise Apparatus: Starting and Extending the Drill String

In general, when starting a drilling operation, the drill string will initially consist of only one drill pipe and a drill head assembly. The drill head assembly typically comprises a variety of components such as a drill bit and a sonde housing to hold a radio transmitting device that locates and controls the drill head assembly during the drilling process.

Referring again to FIG. 1, the drill head assembly (not shown) may be supported by the front centering assembly 20 and the fixed vise assembly 300, or it may be positioned just beyond the front centering assembly 20. The front centering assembly 20 includes a drill pipe centering support 22 that may be adjusted vertically to align a centerline 84 of a drill string 80 with an axis 32 of the spindle 30 (shown in FIG. 2).

A single drill pipe (not shown) moves from a drill pipe storage location into a drill pipe load area 44. In the drill pipe load area 44, the drill pipe is positioned in an axial orientation defined by the longitudinal axis of the spindle 30. The load area 44 lies generally between a rear plane 202 of the rotating vise assembly 200 and a first end 33 of the spindle 30. The load area 44 is effectively open when the thrust frame 50 has been moved back along the rack rails 90 such that the rotational gearbox 40 and spindle 30 are fully retracted. In this loading position, the distance between the rear vise plane 202 and the first end 33 of the spindle 30 is greater than the length of the drill pipe (not shown).

With the thrust frame 50 in the loading position, the first drill pipe is positioned in the drill pipe load area 44 and held by the drill pipe transfer mechanism (not shown). The rotational gearbox 40 rotates the spindle 30 while the spindle 30 is propelled longitudinally by the thrust frame 50. As the spindle 30 propels forward, a threaded male end or pin end 34 of the spindle 30 engages female threads of the drill pipe (not shown).

If the fixed vise assembly 300 supports the drill head assembly, the drill pipe and the spindle 30 are propelled longitudinally until a threaded front end of this first drill pipe is inserted into the drill head assembly. The rotational gearbox 40 continues to rotate the first drill pipe to thread the first drill pipe to the drill head assembly. The fixed vise assembly 300 holds the drill head assembly stationary while the rotational gearbox 40 controls the level of torque applied to properly make-up the threaded joint between the drill head assembly and the first drill pipe. The same level of torque is, at the same time, applied between the first drill pipe and the spindle 30.

If the drill head assembly is out front of the front centering assembly 20, the first drill pipe is propelled forward until a front portion extends into the fixed vise assembly 300. The fixed vise assembly 300 grips the first drill pipe and prevents the first drill pipe from rotating so that proper torque is applied to the joint between the first drill pipe and the spindle 30. Once the joint is properly torqued, the fixed vise assembly 300 releases the first drill pipe and the first drill pipe is propelled through the front centering assembly 20 where the drill head assembly can be installed. The drill head assembly in this case is typically torqued with some form of hand held wrench.

After installing the drill head assembly to the first drill pipe (now referred to as a drill string), the pilot bore process is performed by longitudinally propelling the drill string forward until the joint between the spindle and the drill pipe is located near a middle location 302 between the fixed vise assembly 300 and the rotating vise assembly 200. The fixed vise assembly 300 securely clamps the drill string and the spindle 30 is rotated in a reverse direction while being propelled backward along the rack rails 90 so that another drill pipe can be positioning in the drill pipe load area 44. The process of propelling the rotating spindle forward and applying proper torque between the joints of the drill pipes is repeated to effectively extend the drill string. The drill string is extended until the underground drill path reaches a desired distance. Thus the main function of the fixed vise assembly 300 of the vise apparatus 100 in performing the pilot bore process is to hold the drill string in a stationary position while a new drill pipe is positioned and threaded into the drill string.

III. Operation of the Vise Apparatus: Retracting the Drill String

The pull-back process involves pulling the drill string back through the pilot bore. The thrust frame 50 is reversed in the longitudinal direction to pull the drill string back until a first joint between the last added drill pipe and the remainder of the drill string is located at the middle location 302. At this position, the fixed vise assembly 300 clamps the drill string. The rotating vise assembly 200 rotates clockwise in an opened, unclamped position, clamps the last added drill pipe at a first location, and rotates counterclockwise to break the joint between the last added drill pipe and the drill string. The rotating vise assembly 200 then opens to release the last added drill pipe. The rotational gearbox 40 reverse rotates while the thrust frame moves back to separate the last added drill pipe from the drill string. Once the last added drill pipe is separated from the drill string the rotating vise assembly 200 clamps the last added drill pipe at a second location. The spindle 30 reverse rotates to break a second joint between the spindle 30 and the last added drill pipe. Once that joint is broken and the last added drill pipe is separated from the spindle 30, the rotating vise assembly 200 opens and the drill pipe is removed. To continue the process, the spindle 30 translates forward to mate with the drill string still clamped by the fixed vise assembly 300. The spindle is threaded to the drill string with the proper torque. The fixed vise assembly 300 opens and the drill string is pulled backwards to repeat the break-out procedure.

Thus, the functions of the vise apparatus 100 in the pull-back process include breaking the first joint between the drill string and the last added drill pipe, holding the drill pipe while the second joint between the drill pipe and spindle is broken, and holding the drill string while the spindle is re-attached to repeat the break-out procedure.

IV. Structural Description of the Vise Apparatus

The vise apparatus 100 is shown in FIGS. 3–7. One feature of the vise apparatus 100 permits proper positioning of the vise assemblies 200, 300 relative to one another.

Figure 3:
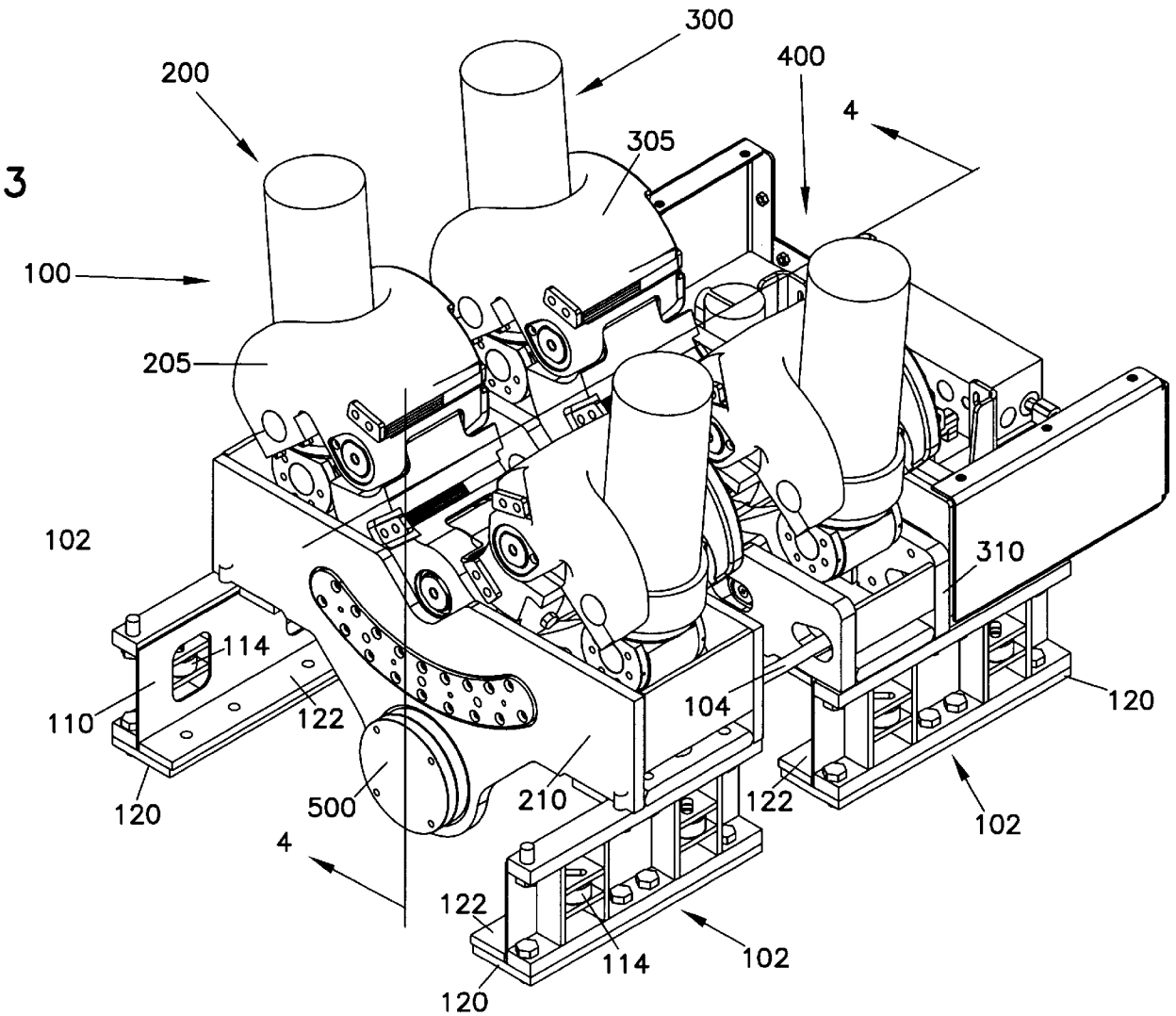
FIG. 3 is a front perspective view of a vise apparatus shown assembled to the rack assembly of FIG. 1, illustrating vise assemblies positioned in a space-apart relation.
Figure 3A:
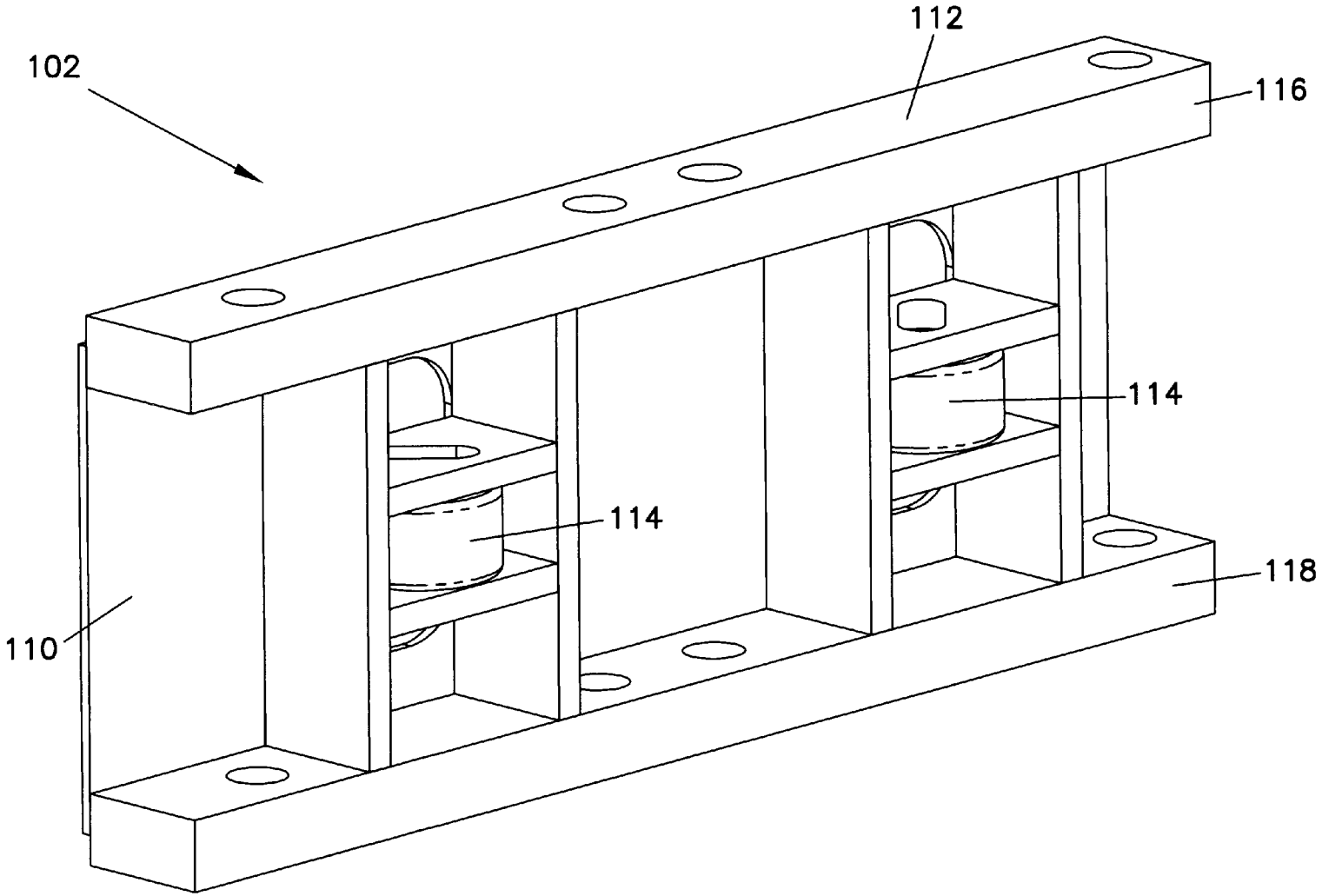
FIG. 3A is a front perspective view of a mounting bracket shown in FIG. 3.

Specifically, the fixed vise assembly 300 includes a fixed vise mechanism 305 and a fixed vise frame 310. The rotating vise assembly 200 includes a rotating vise mechanism 205 and a rotating vise frame 210. As illustrated in FIGS. 3 and 3A, mounting brackets 102 are located in four places: one pair supports the fixed vise assembly 300 and the other pair supports the rotating vise assembly 200.

Each mounting bracket 102 includes a side plate 110. The side plate 110 includes an upper member 116 and a lower member 118. An upper surface 112 of the upper member is designed to fixedly attach to the fixed vise frame 210 or 310. The lower member 118 couples to a bottom plate 120. The bottom plate 120 is designed such that when the upper surface 112 of the upper member 116 is attached to the vise frame 210 or 310 and the bottom plate 120 is bolted to the lower member 118, the entire assembly 200 or 300 is trapped or secured onto the rack rails 90. Rollers 114 are supported in the side plates 110 to maintain clearance between the rack rail 90 and the side plate 110 (see FIG. 7).

Figure 7:
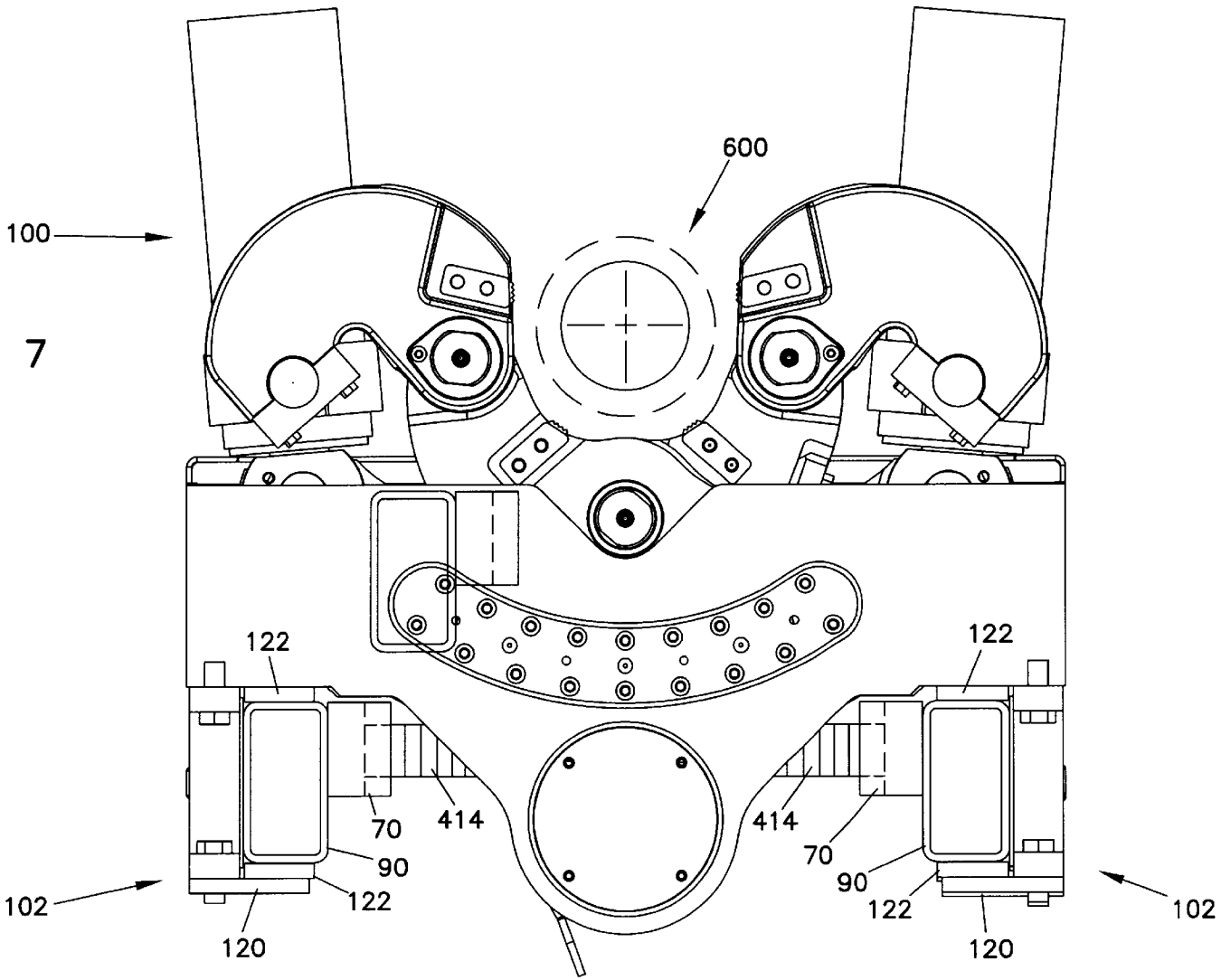
FIG. 7 is a front view of the vise apparatus mounted onto rails as shown in FIG. 1.

Bearing plates 122 made in the form of flat plates are utilized as bearings between the vise frame 210, 310 and the rack rail 90 (FIG. 7). Bearing plates 122 are also located between the rack rail 90 and the bottom plate 120. The bearing plates 122 may be made from bearing material, such Ultra High Molecular Weight plastics, for example. This mounting arrangement assists the vise assemblies 200 and 300 in moving to move along the rack rails 90 relative to one another.

Figure 4:
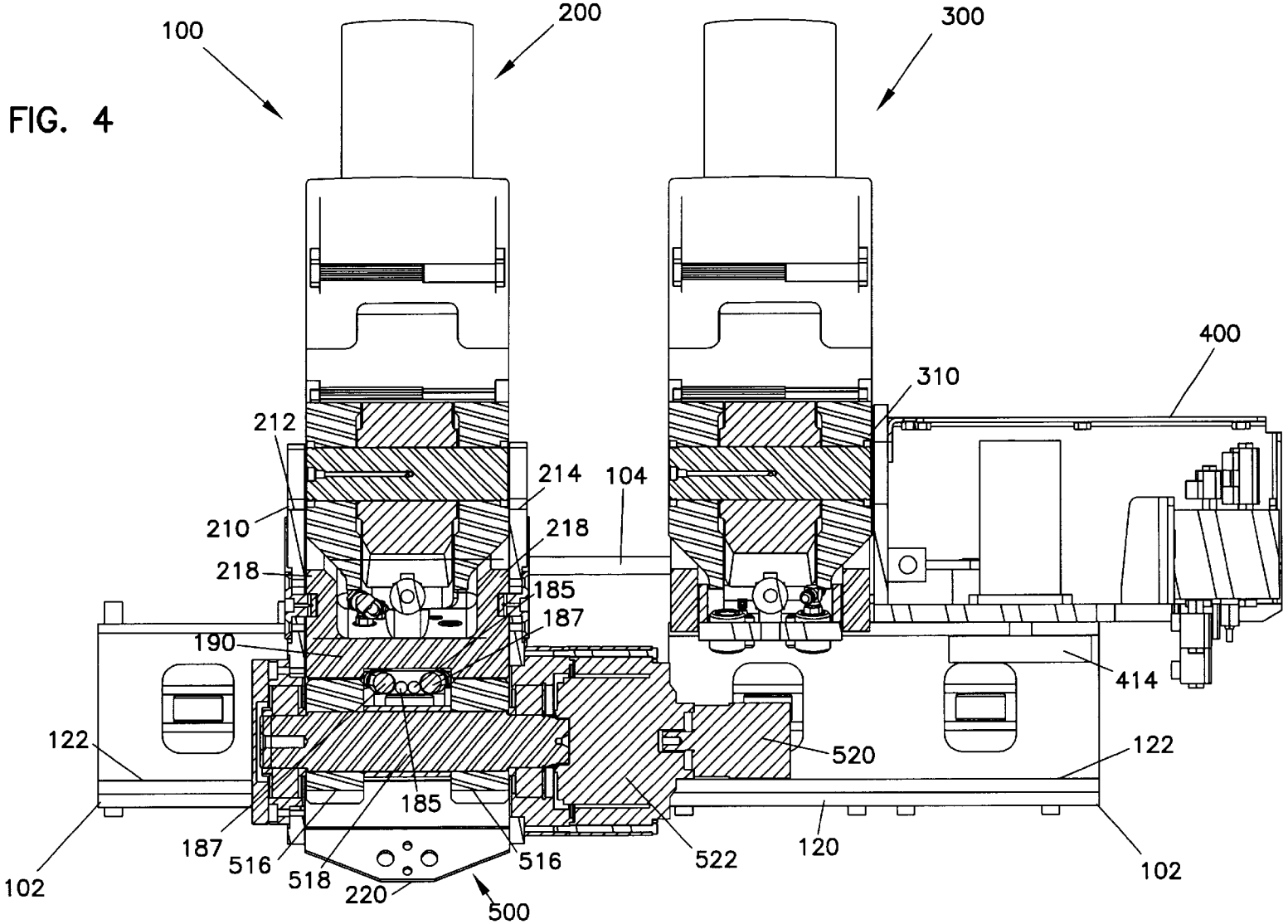
FIG. 4 is a cross-sectional view of the vise apparatus taken along line 4—4 of FIG. 3.
Figure 5:
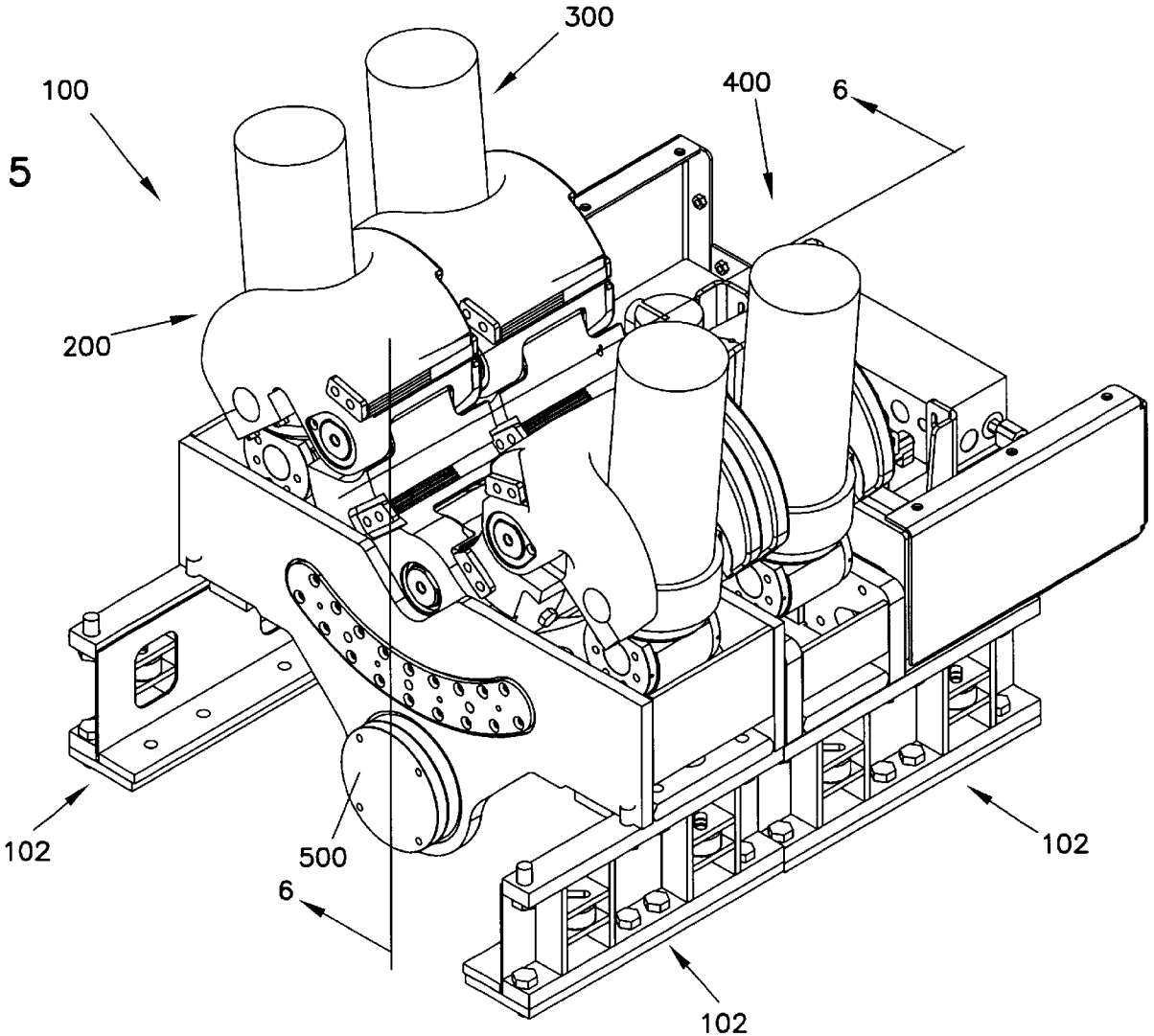
FIG. 5 is a front perspective view of the vise apparatus shown in FIG. 3, illustrating the vise assemblies position in a close relation.
Figure 6:
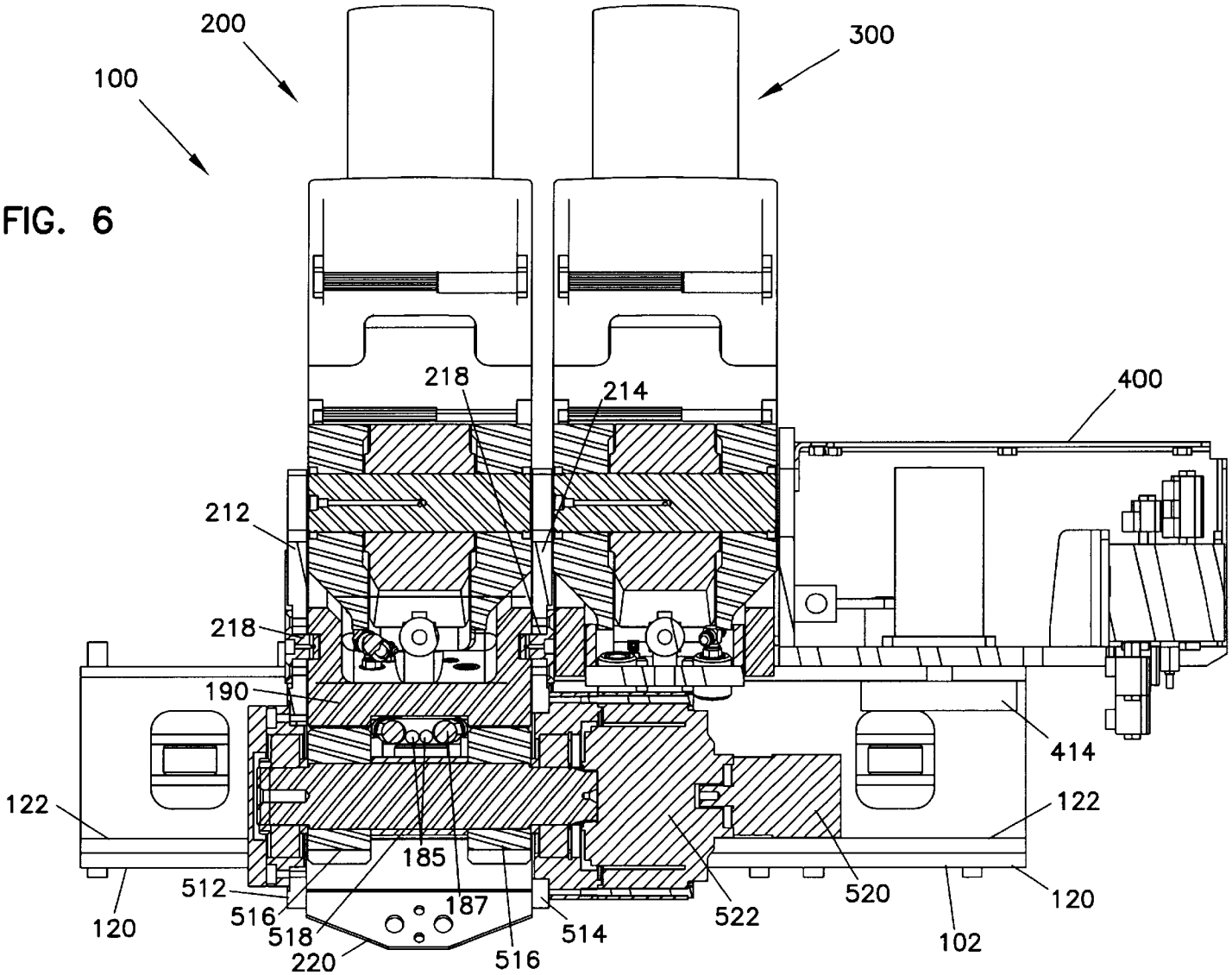
FIG. 6 is a cross-sectional view of the vise apparatus taken along line 6—6 of FIG. 5.

The relative movement between the vise assemblies 200 and 300 is effected by a pair of separation cylinders 104 (FIG. 4). The relative movement is in a direction parallel to the rails 90. The separation cylinders 104 are attached to the vise frames 210 and 310. As can be seen by comparing FIGS. 4 and 6, the separation cylinders 104 control the position of the vise assemblies 200 and 300 relative to one another. The vise assemblies may nearly touch, as shown in FIG. 6, or be substantially separated, as shown in FIG. 4. This feature allows the separation distance to be selectively controlled for visibility of the drill string joints of various sized drill pipes.

Figure 8:
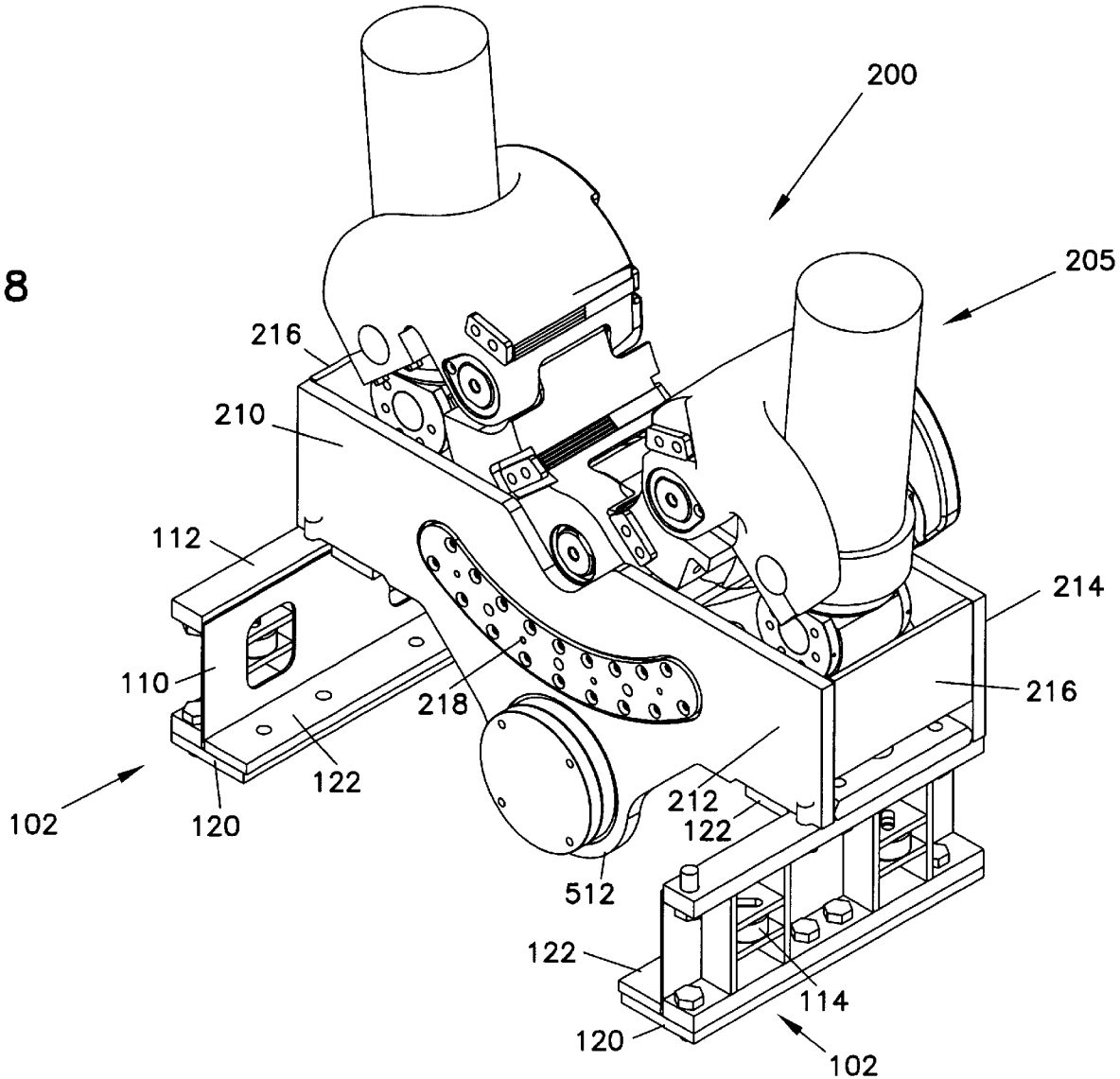
FIG. 8 is a front perspective view of a rotating vise assembly of the vise apparatus of FIG. 3.
Figure 8A:
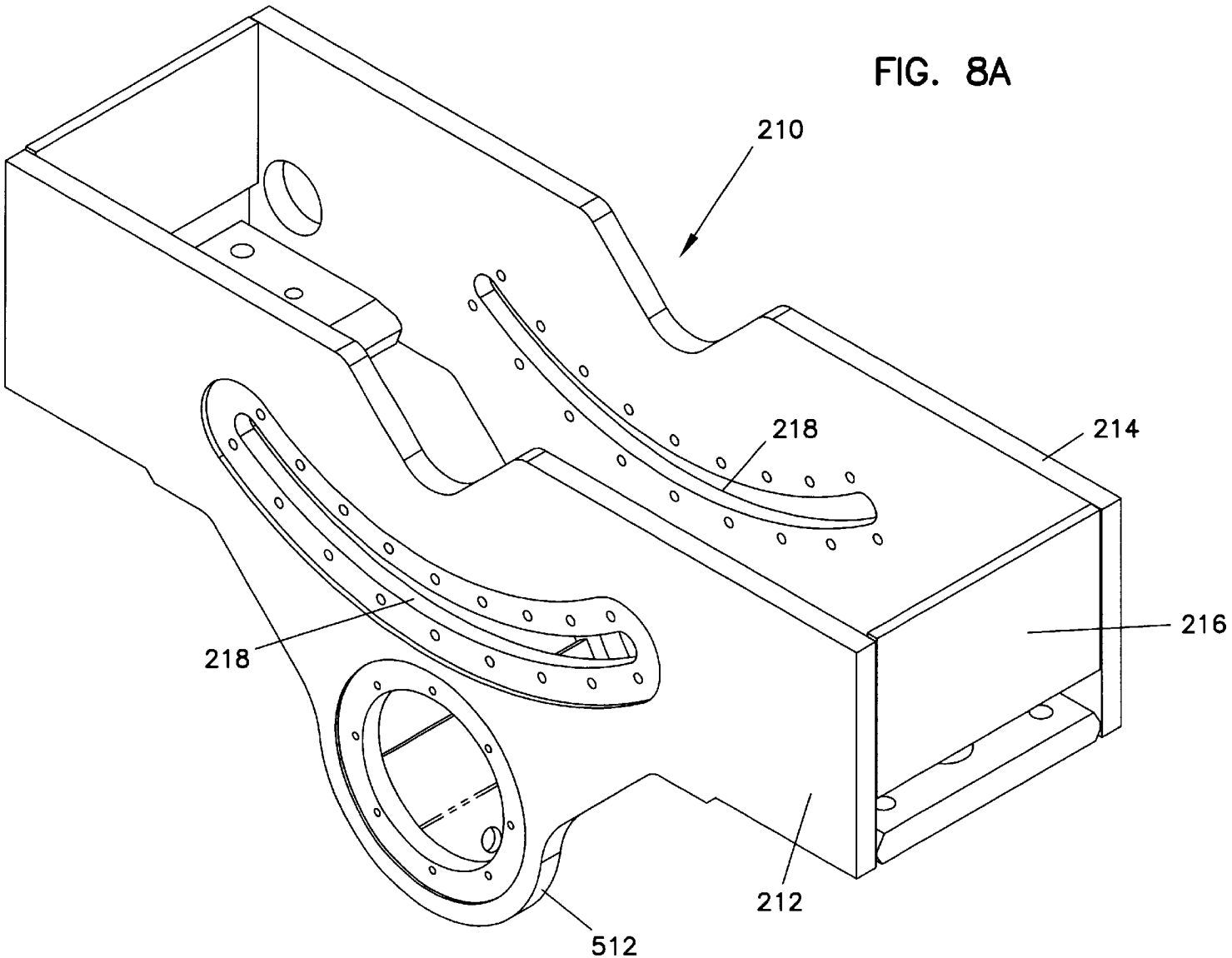
FIG. 8A is a side perspective view of a rotating vise frame shown in FIG. 8.
Figure 9:
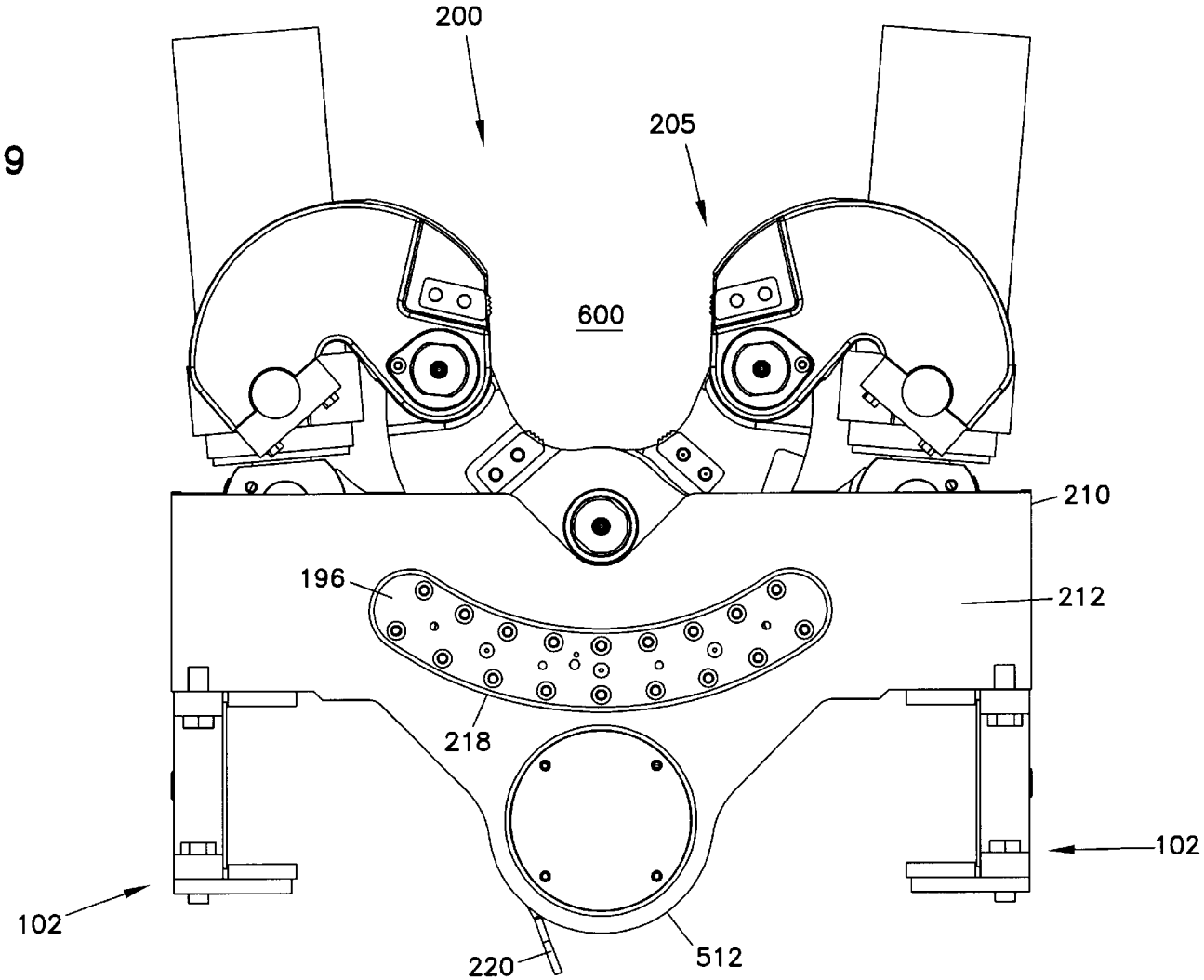
FIG. 9 is an end view of the rotating vise assembly of FIG. 8.
Figure 10:
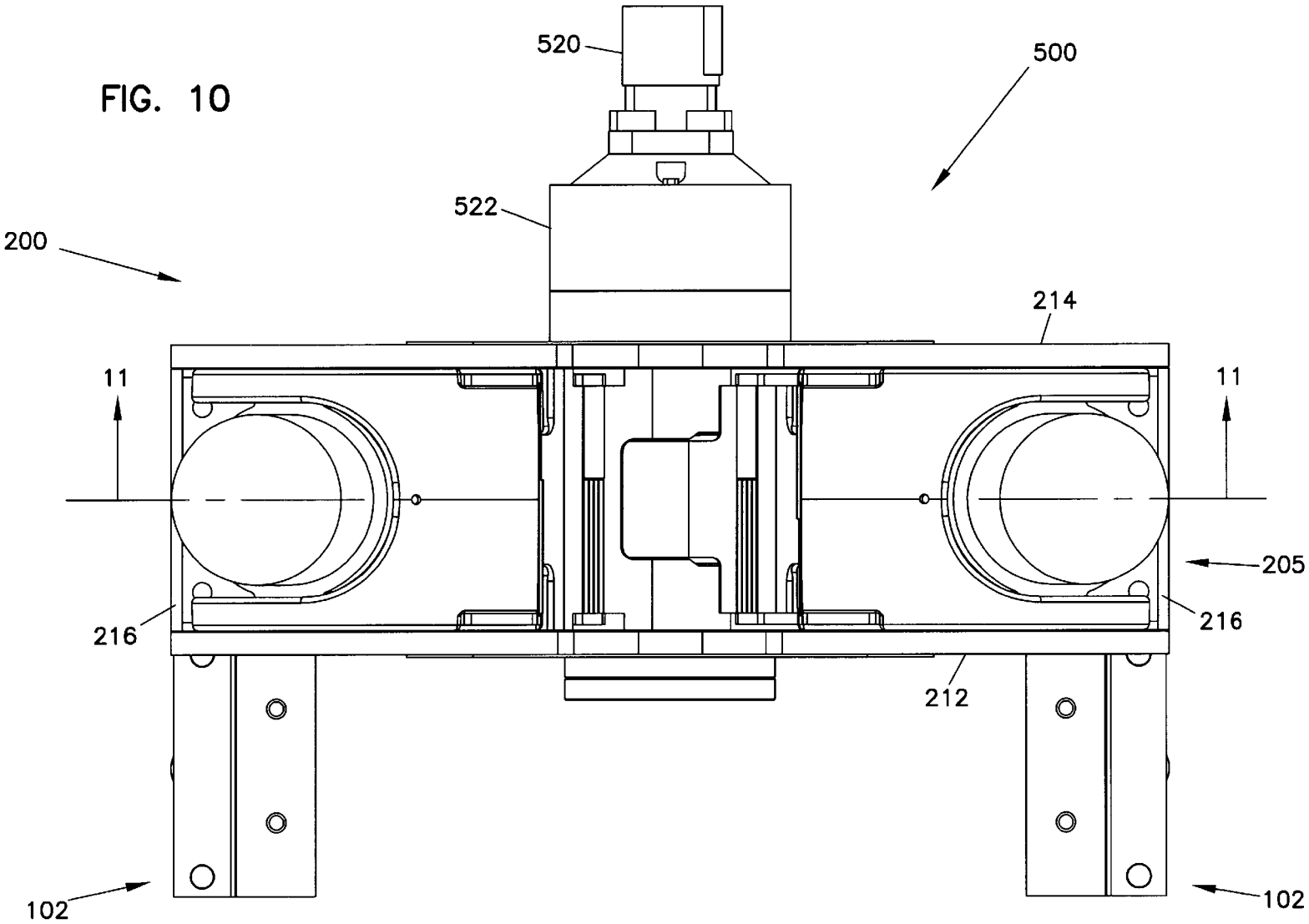
FIG. 10 is a top view of the rotating vise assembly of FIG. 8.

The rotating vise assembly 200 is shown in more detail in FIGS. 8, 9 and 10. The rotating vise frame 210 of the rotating vise assembly 200 includes two parallel side plates 212 and 214 separated by end plates 216. The side plates 212 and 214 both include an arcuate feature or slot 218 that defines a mounting location of the rotating vise mechanism 205.

Figure 11:
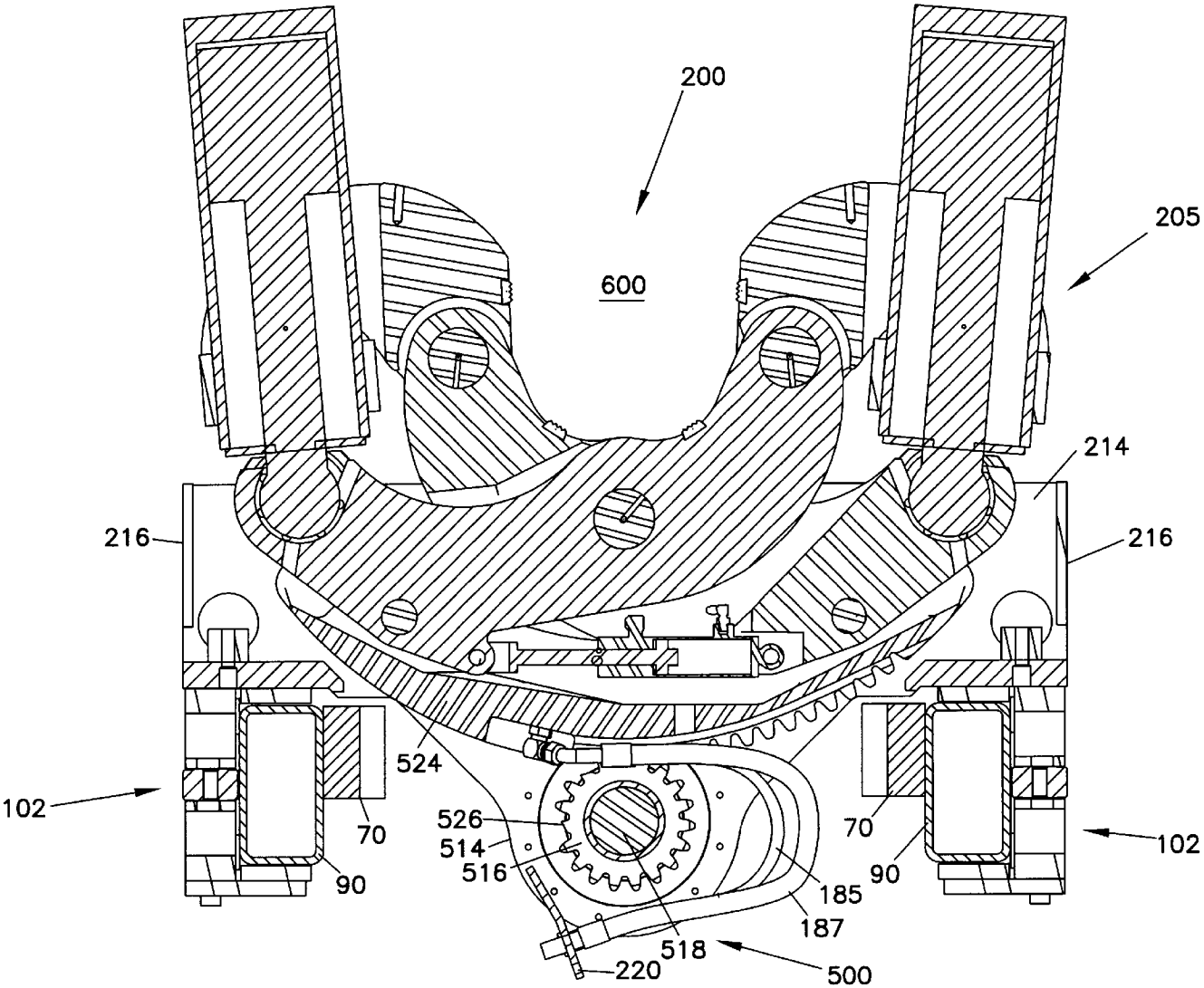
FIG. 11 is a cross-sectional view of the rotating vise assembly taken along line 11—11 of FIG. 10 shown in a non-rotated position.

Referring now to FIGS. 9 and 11, the side plates 212 and 214 of the rotating vise frame 210 include ear portions 512 and 514. The ear portions 512 and 514 provide support for a rotational drive shaft 518 that supports rotational drive gears 516 (FIG. 11). The ear portions 512 and 514 also provide a mounting surface for the rotational drive motor 520 and rotational drive gearbox 522 (FIG. 10). The rotational drive motor 520 and the rotational drive gearbox 522 function to rotate the rotating vise mechanism 205 during break-out operation.

The fixed vise frame 312 of the fixed vise assembly 300 is shown in more detail in FIGS. 12, 13, 14 and 15. The fixed vise frame 310 is likewise defined by side plates 312 and 314 that are separated by end plates 316. The side plates 312 and 314 also include slots 318 that define a mounting location of the fixed vise mechanism 305.

Figure 16:
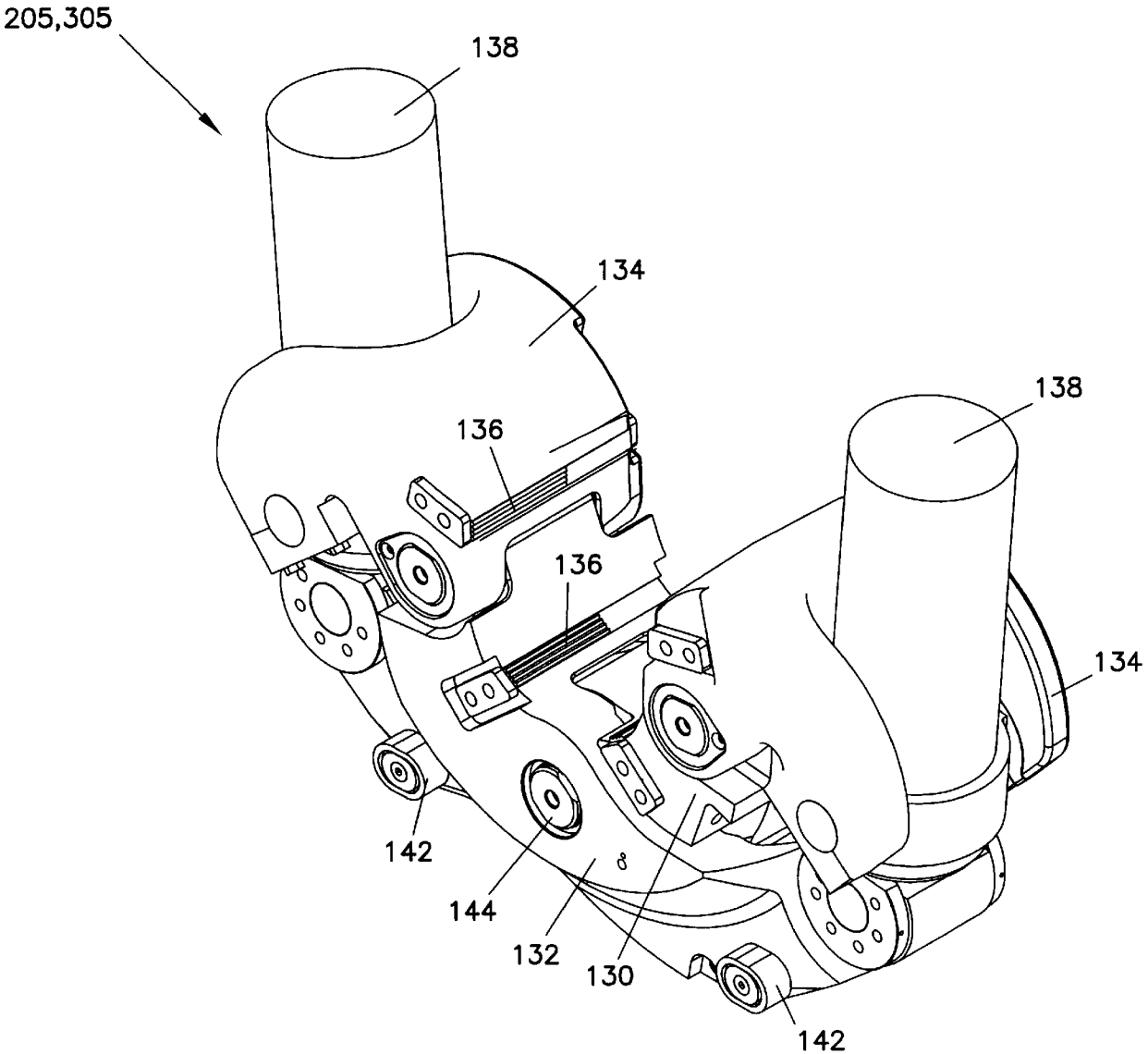
FIG. 16 is a front perspective view of a vise mechanism of the vise apparatus of FIG. 3.
Figure 18:
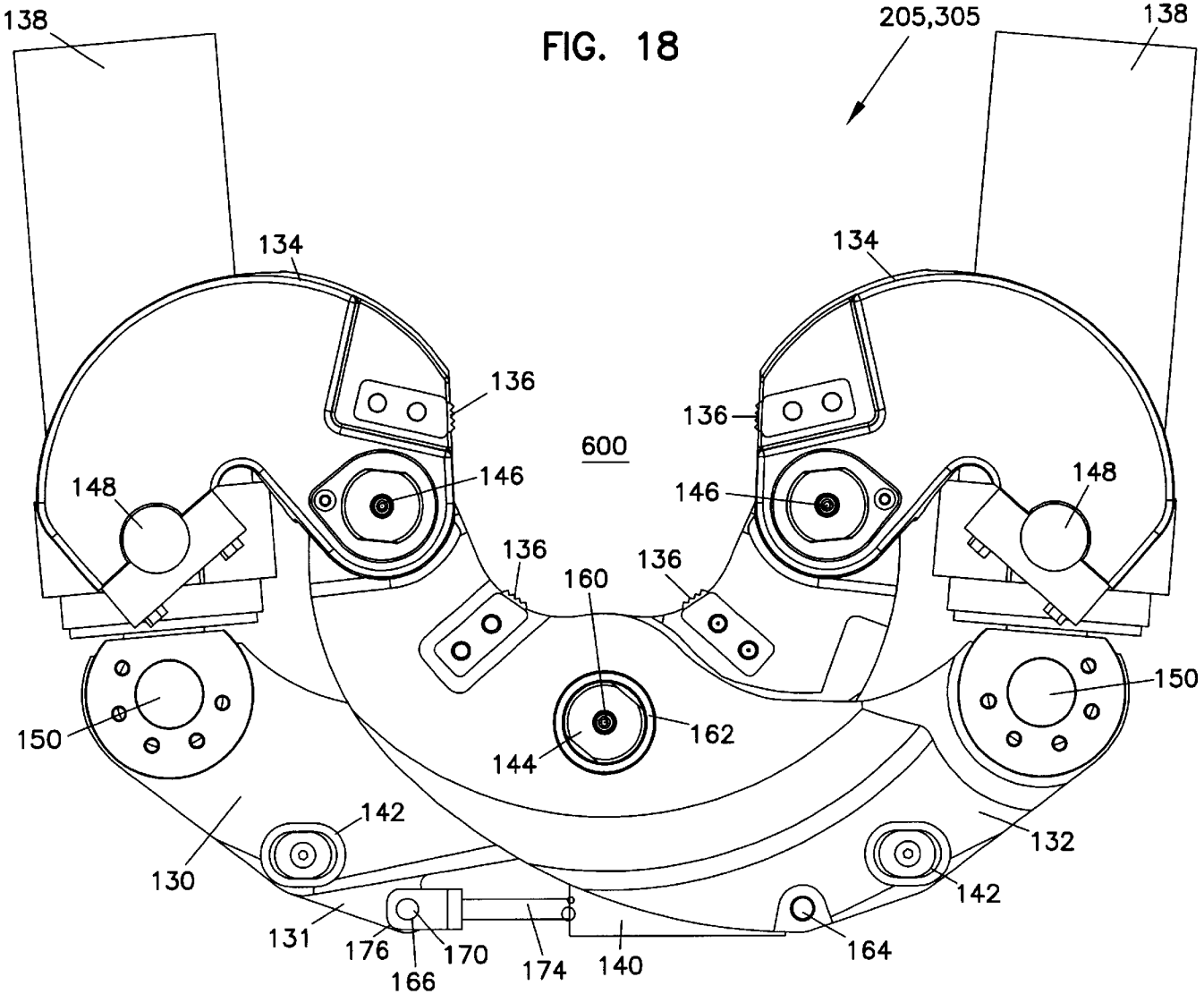
FIG. 18 is an end view of the vise mechanism of FIG. 16.

The rotating vise mechanism 205 and the fixed vise mechanism 305 are identical. As shown in FIGS. 16 and 18, the vise mechanisms 205, 305 include a male scissors link 130 and a female scissors link 132 that fit together at a main pivot connection 144 with a main pivot pin 160. The main pivot connection 144 is defined by a through hole in the male scissors link 130 and two coaxial holes through the sides of the female scissors link 132. The main pivot pin 160 passes through these holes and is retained by a snap ring 162. A variety of retaining members may be used to retain the pin in position.

The scissors links 130 and 132 also include attachment points for a lift cylinder 140. A female lift cylinder attachment point 164 is located on the female scissors link 132 and a male lift cylinder attachment point 166 is located on the male scissors link 130. The female lift cylinder attachment point 164 is defined by two coaxial holes in the sides of the female scissors link 132. The lift cylinder 140 terminates with a plate (not shown) having a through hole. A pin 168 (best shown in FIG. 19A) passes through the sides of the female scissors link 132 and through the hole in the cylinder plate to secure the cylinder 140 to the female scissors link 132. The opposing rod end 174 of the lift cylinder 140 terminates in a female yoke 176. The female yoke fits over a male scissors portion 131 of male scissors link 130 at the lift cylinder attachment point 166. A pin 170 passes through the yoke 176 and the scissors portion 131 to secure the opposing rod end 174 of the lift cylinder 140 to the male scissors link 130.

The male and female scissor links 130, 132 define an opening or pocket 600 configured to receive drilling pipe. In accord with the principles of this disclosure, the pockets 600 of the vise mechanisms 205 and 305 are adapted to accommodate a variety of sized drill pipe or drill bit assemblies. This is accomplished by the linkage arrangement that properly positions the vise mechanisms to correspond to a particular sized drill pipe, for example.

The position of the vise mechanism is defined by the position of the scissors links 130 and 132. All other components work in conjunction with, and correspond to, the position of the scissors links 130 and 132. The scissors links 130 and 132 are positioned by operation of the lift cylinder 140 in cooperation with positioning pins or cams 142. In particular the size of the pocket 600 is adjusted by actuation of the lift cylinder 140. The vise mechanism 205 and 305 has four positioning cams 142. One pair of positioning cams 142 are located on opposing sides of the male scissors link 130 and another pair of positioning cams are located on opposing sides of the female scissors link 132.

Figure 12:
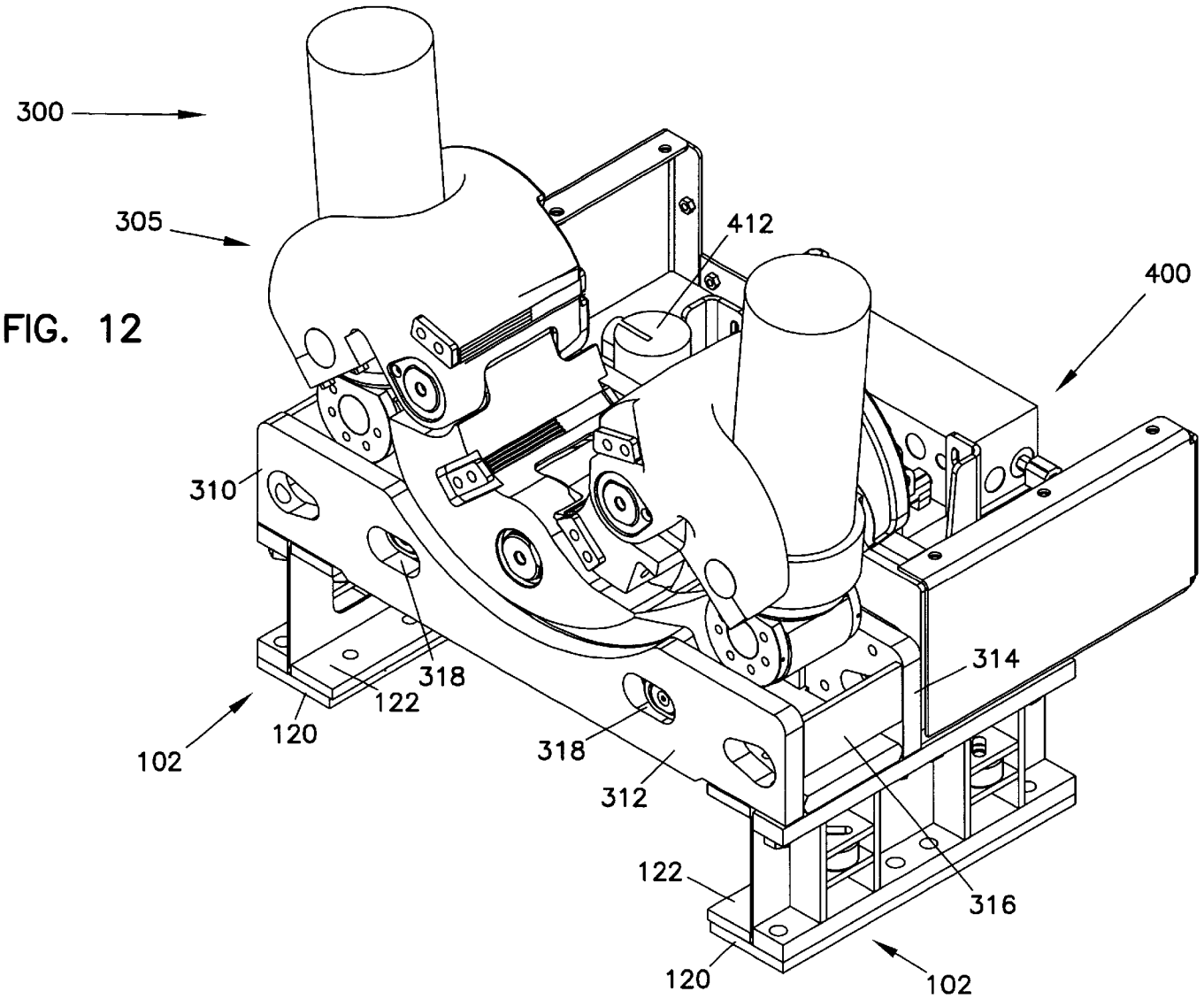
FIG. 12 is a front perspective view of a fixed vise assembly of the vise apparatus of FIG. 3.
Figure 13:
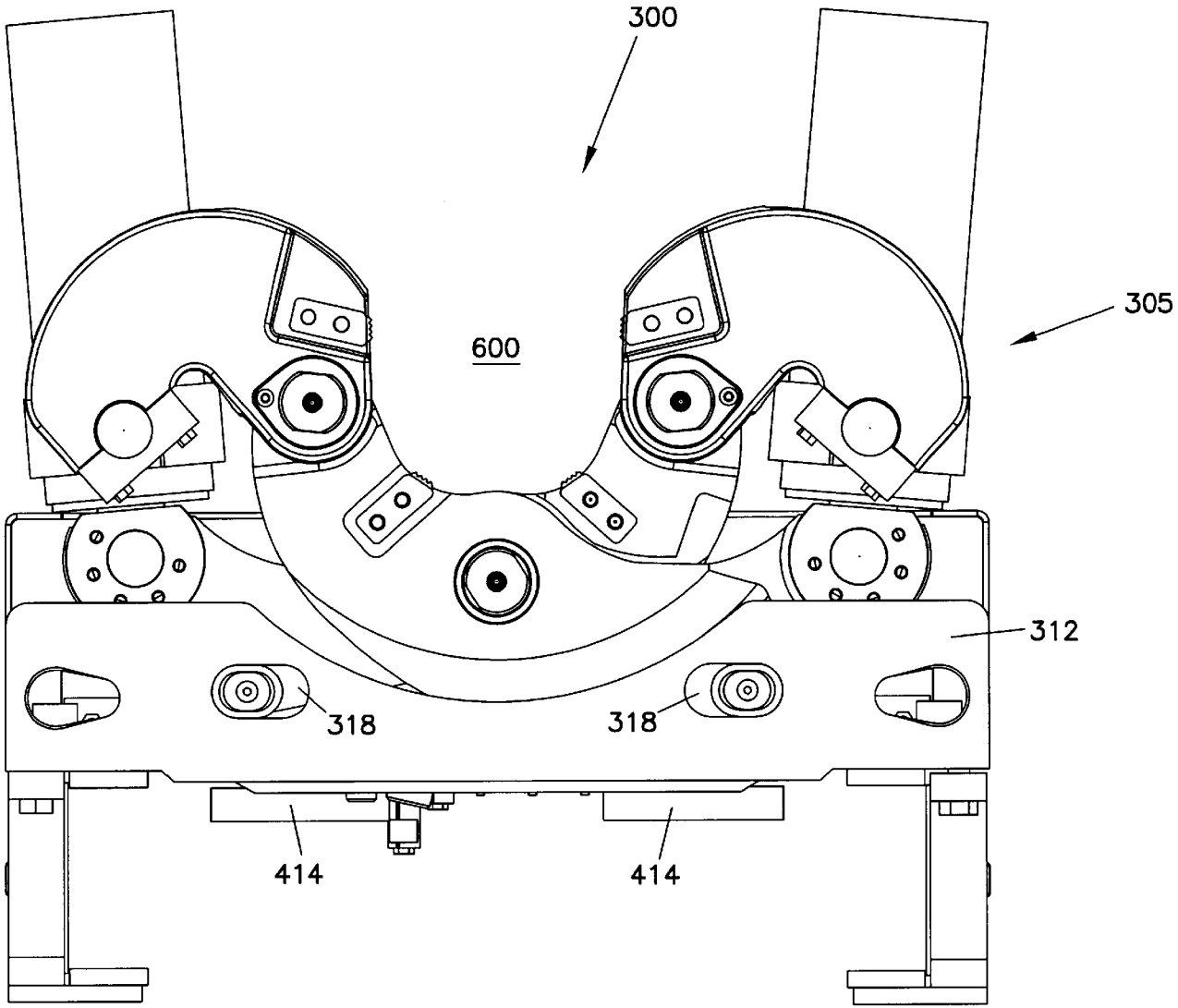
FIG. 13 is an end view of the fixed vise assembly of FIG. 12.
Figure 14:
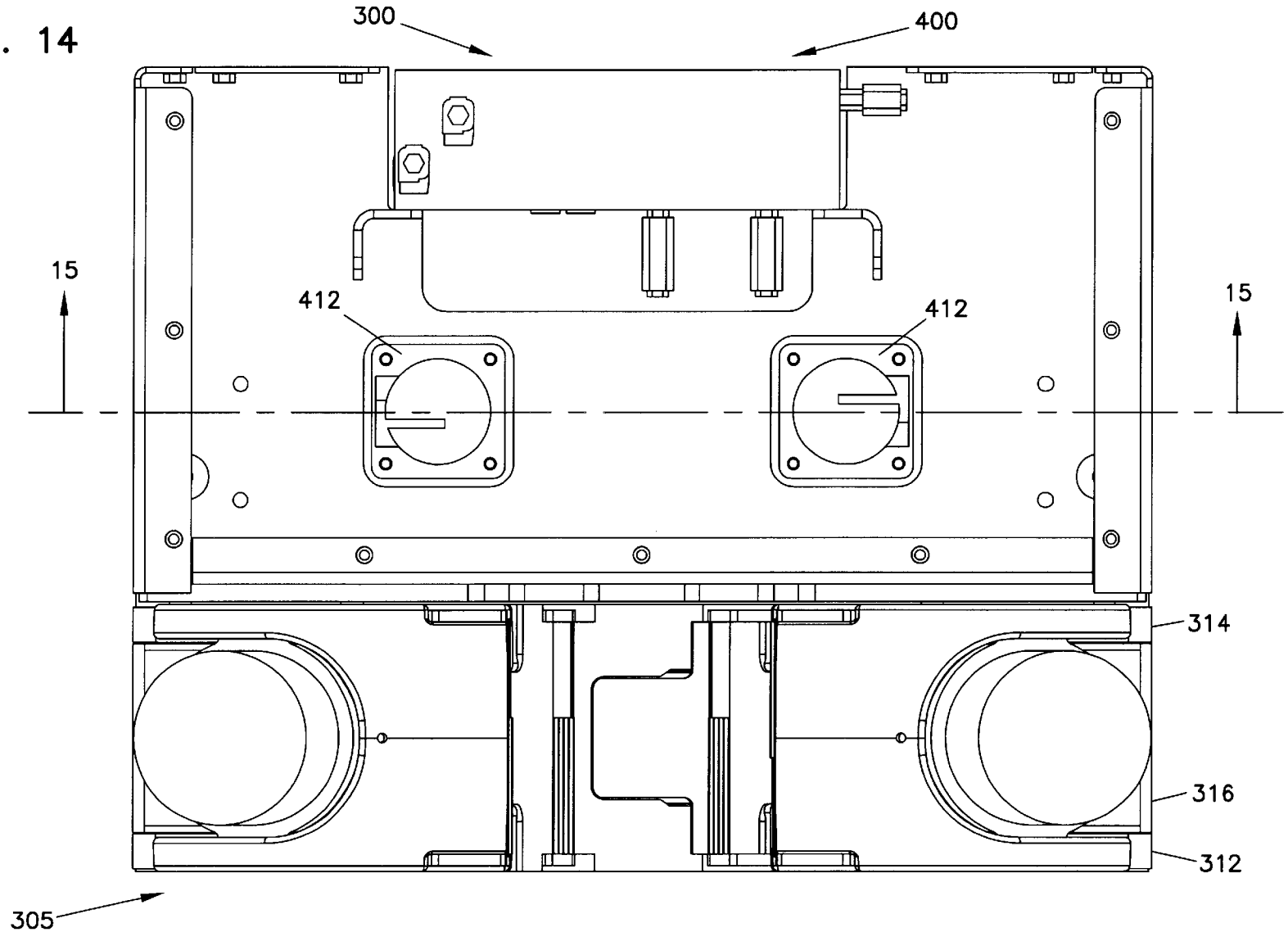
FIG. 14 is a top view of the fixed vise assembly of FIG. 12 and a longitudinal positioner assembly.
Figure 15:
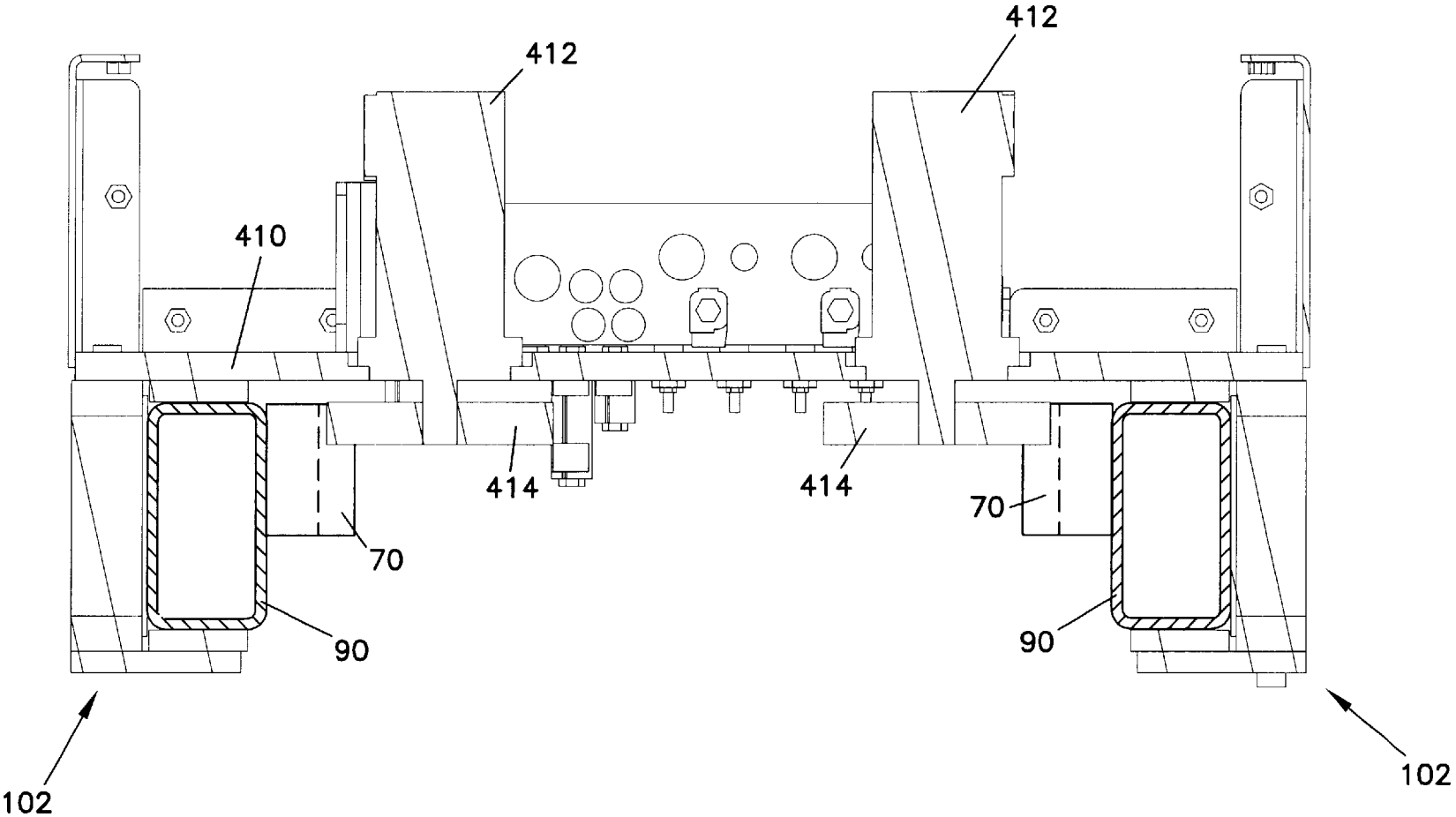
FIG. 15 is a cross-sectional view of the longitudinal positioner assembly taken along line 15—15 of FIG. 14.

The positioning cams 142 of the fixed vise mechanism 305 operate in conjunction with positioning slots 318 (FIG. 12) of the fixed vise frame 310. These positioning cams 142 directly engage the positioning slots 318 in the side plates 312 and 314 (FIG. 12).

Figure 20:
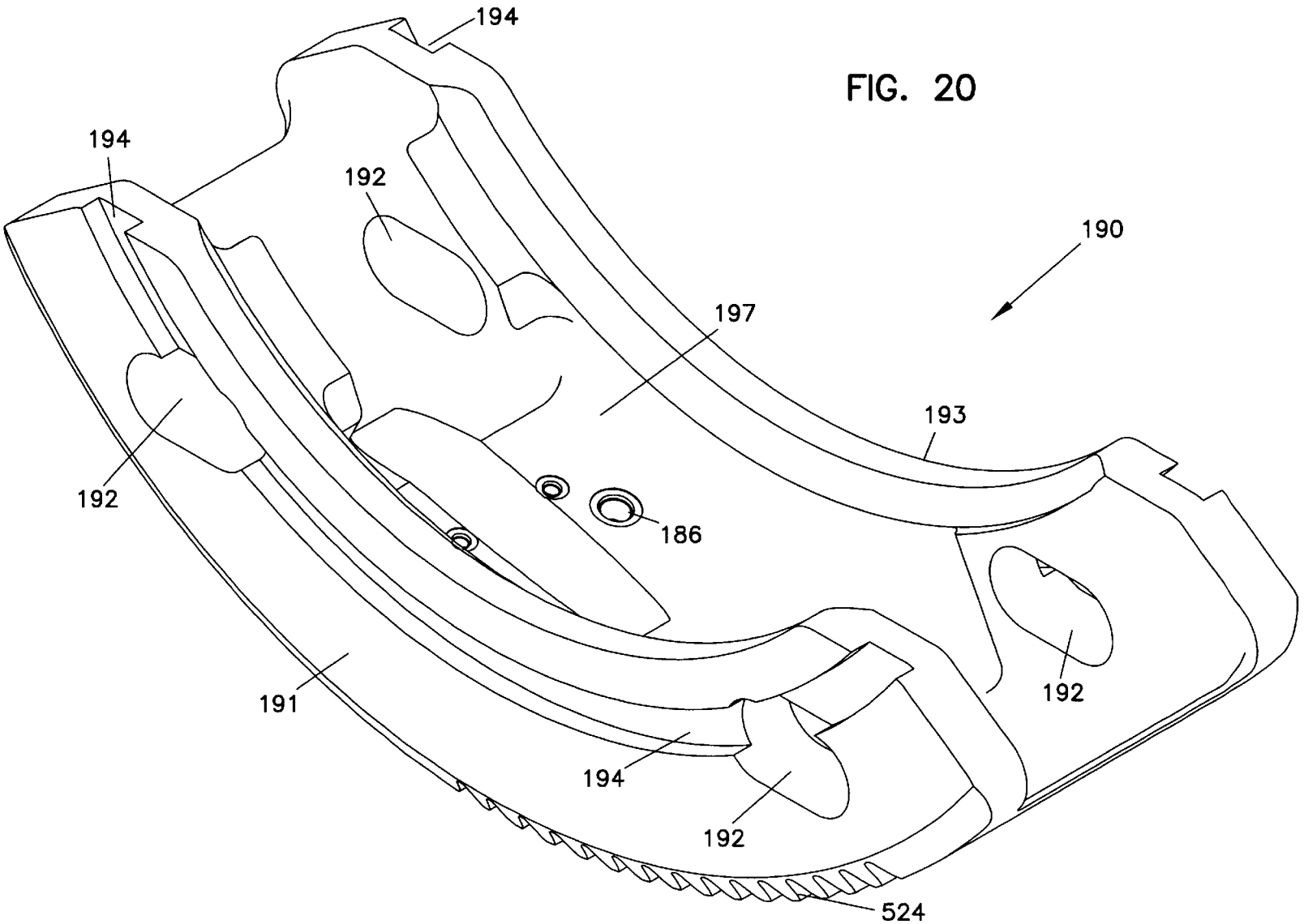
FIG. 20 is an isometric view of a rotary positioner used in the assembly of the rotating vise assembly of FIG. 8.
Figure 21:
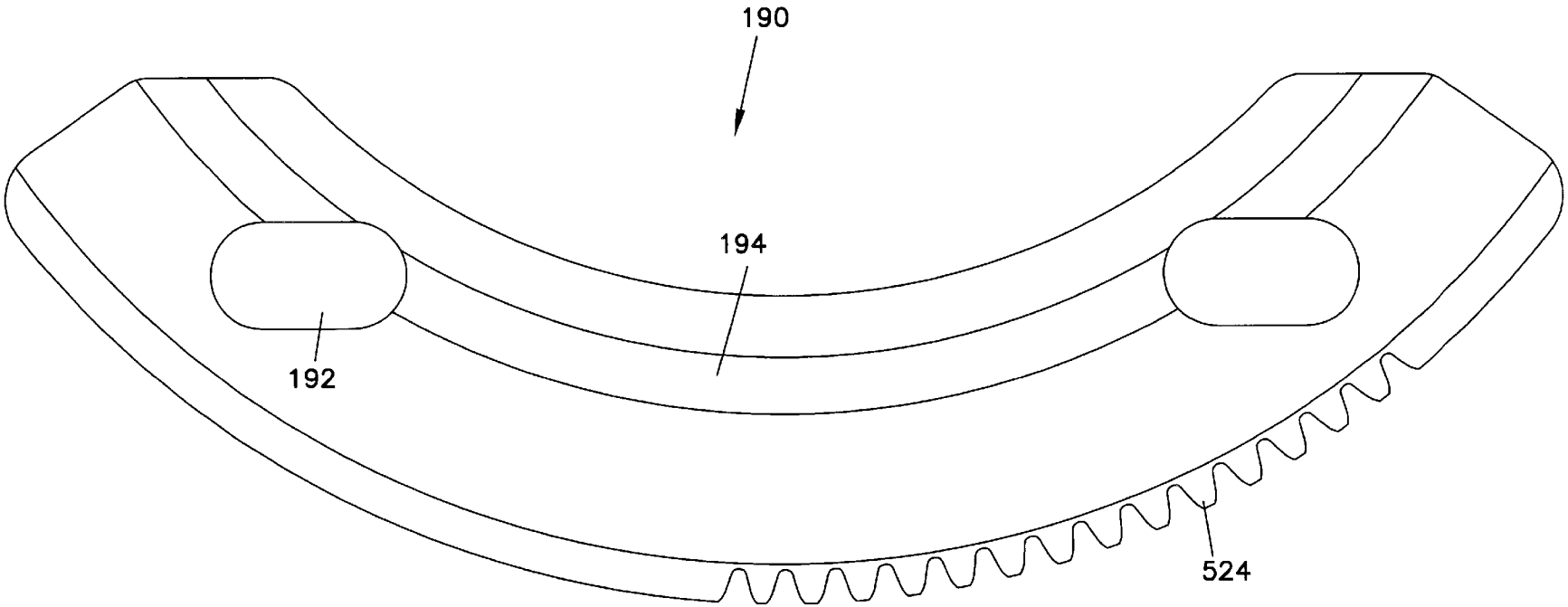
FIG. 21 is an end view of the rotary positioner of FIG. 20.
Figure 22:
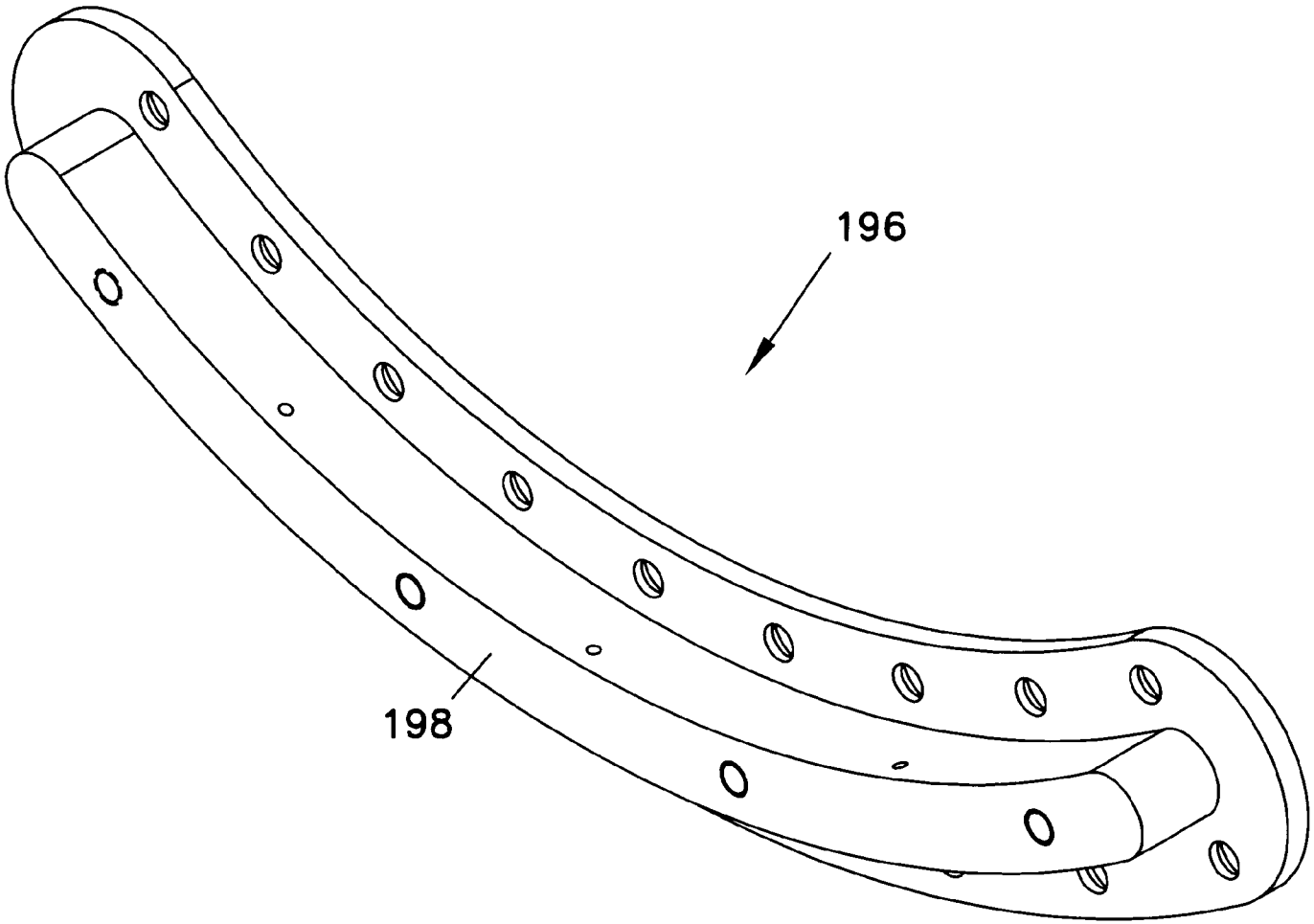
FIG. 22 is an isometric view of an arcuate tab bracket used in the assembly of the rotating vise assembly of FIG. 8.

The positioning cams 142 of the rotating vise mechanism 205 engage positioning mechanism slots 192 of a rotary positioner 190, shown in FIGS. 20 and 21. The rotary positioner 190 includes a partial external gear 524 having a center of rotation approximately coincident with a center of the pocket 600 defined by the scissor links of the rotating vise mechanism 205. The rotary positioner 190 also includes an arcuate slot 194 on both sides 191 and 193 of the rotary positioner 190. The arcuate slots 194 engage with an arcuate tab 198 of an arcuate tab bracket 196, shown in FIG. 22. As best illustrated in FIGS. 8 and 9, the arcuate tab bracket 196 is operatively arranged to function with slot 218 of the rotating vise frame 210. The arcuate tab bracket 196 fits into slot 218 and defines a spatial relationship between the arcuate tab 198 and the rotating vise frame 210 to permit limited rotational movement of the rotating vise mechanism 205. The rotary vise mechanism 205 includes two arcuate tab brackets 196 on either side of the mechanism. In rotational operation, the arcuate tabs 198 define the position of the rotary positioner 190 and the rotary positioner 190 defines the position of the positioning cams 142 to orient the vise mechanism 205. In clamping operation, the position of the vise mechanism 205 is defined by the scissors links 130 and 132.

Figure 17:
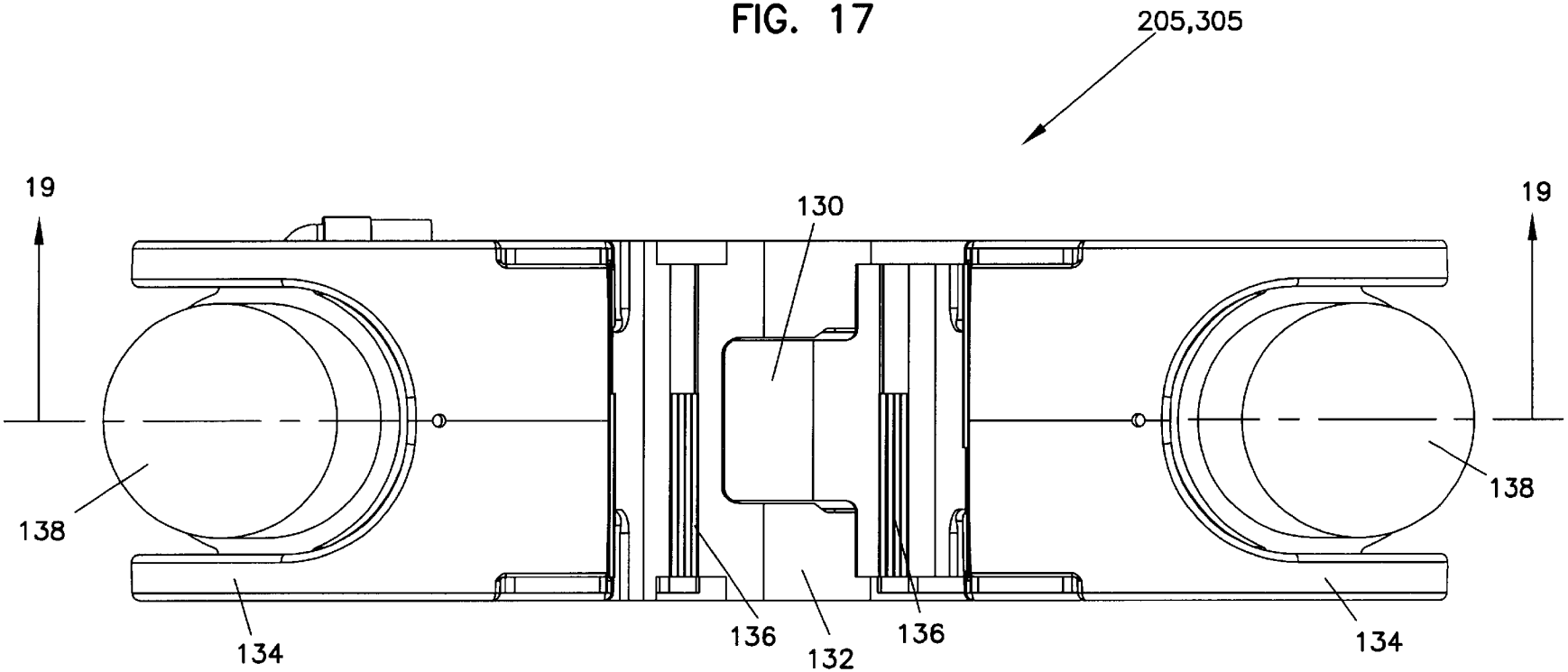
FIG. 17 is a top view of the vise mechanism of FIG. 16.
Figure 19A:
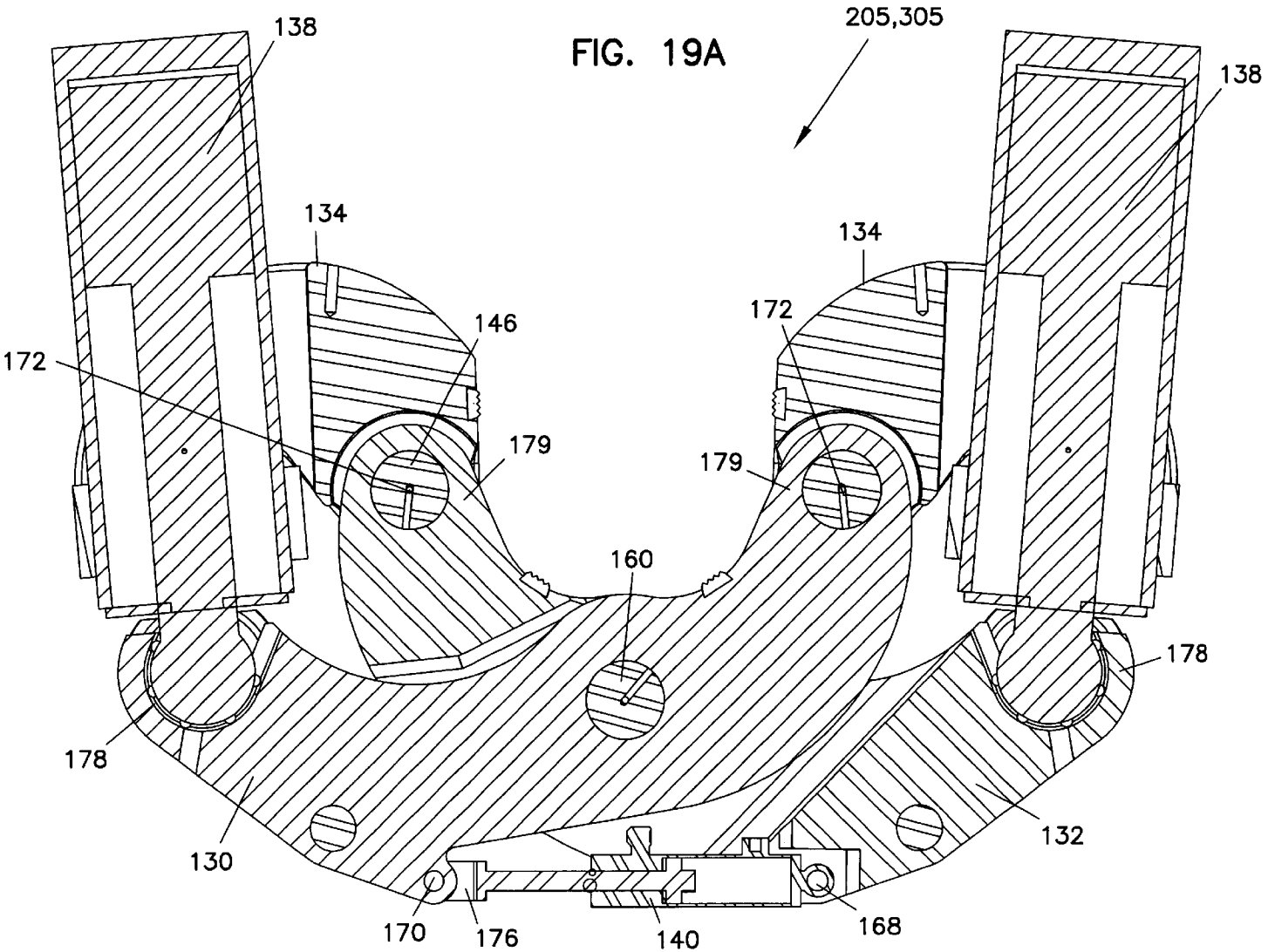
FIG. 19A is a cross-sectional view of the vise mechanism taken along line 19—19 of FIG. 17 illustrating the vise mechanism in an open position.
Figure 19B:
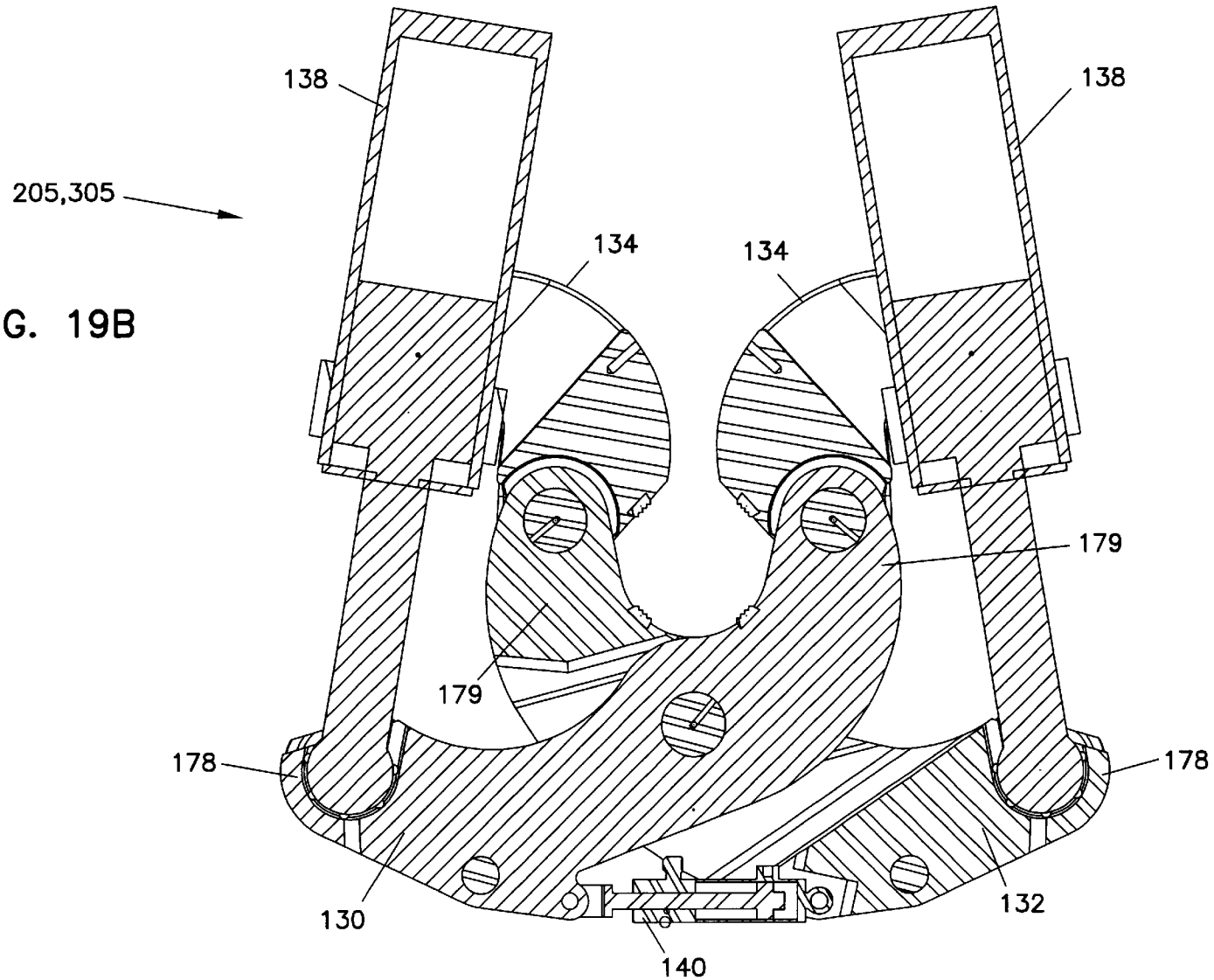
FIG. 19B is a cross-sectional view of the vise mechanism taken along line 19—19 of FIG. 17 illustrating the vise mechanism in a closed position.

The clamping action of the vise mechanisms 205 and 305 is illustrated in FIGS. 17, 18, 19*a* and 19*b*. FIG. 17 illustrates a cross-sectional line 19—19 along which FIGS. 19*a* and 19*b* are viewed. FIGS. 18 and 19*a* illustrate the vise mechanism in an open position. The vise mechanisms 205 and 305 include clamp cylinders 138 pivotally connected to drive ends 178 of the scissors links 130 and 132 by rod pivots 150. In the open position, the clamp cylinders 138 are retracted and the lift cylinder 140 is extended. The opening of the vise mechanism is maximized for insertion of drill pipes or a drill head assembly.

FIG. 19*b* illustrates the vise mechanism in a closed or clamped position having a minimized opening. In the clamped position, the clamp cylinders 138 are extended and the lift cylinder 140 is retracted.

The vise mechanisms 205 and 305 further include two linked retaining structures or tong heads 134 pivotally coupled at tong head pivot connections 146 to pivot, clamp or translating ends 179 of the scissors links 130 and 132. The tong head pivot connections 146 are defined by through holes in the scissors links 130 and 132, corresponding holes in the tong heads 134, and pivot shafts 172. The tong heads 134 are also pivotally coupled to each clamp cylinder 138 at clamp cylinder pivot mount locations 148. Each vise mechanism 205 and 305 further includes four vise die or gripping members 136. One gripping member is located on each of the scissors links 130 and 132 and on each of the tong heads 134. It is contemplated that more or less gripping members may be used in accordance with the principles disclosed. In the illustrated embodiment, the gripping members 136 are located such the gripping members contact a drill pipe, for example, at approximately 90-degree intervals.

Figure 24:
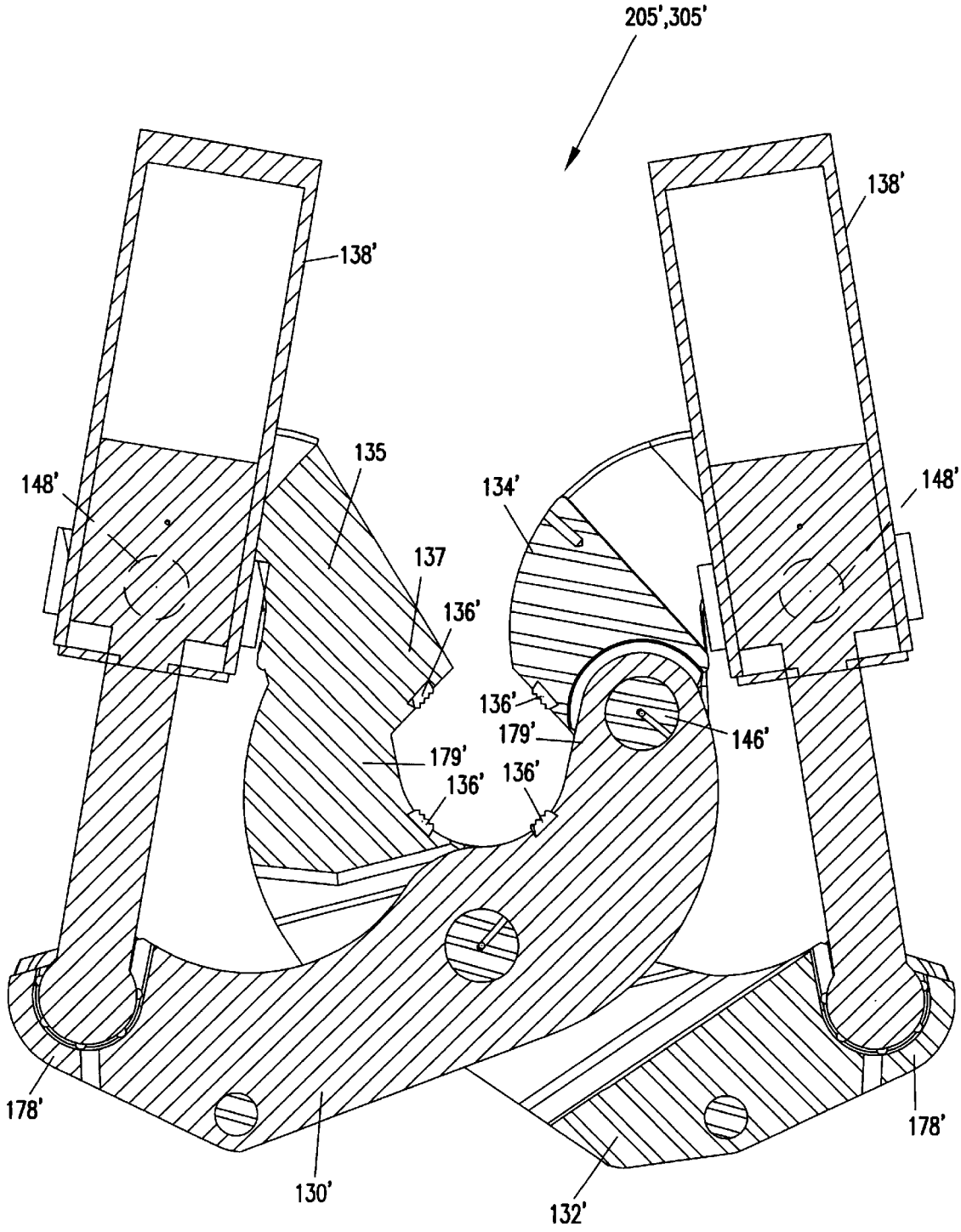
FIG. 24 is a cross-sectional view of an alternative embodiment of a vise mechanism in accordance with the principles of this disclosure.

Referring now to FIG. 24, an alternative embodiment of a vise mechanism 205', 305' is illustrated. Similar to the vise mechanism 205, 305, this alternative embodiment includes male and female scissor links 130' and 132' each having a drive end 178' and a clamping, pivoting, or translating end 179'. Clamping cylinders 138' are pivotally coupled to the drive ends 178' of the scissor links 130', 132'. The male scissor link 130' has a pivot connection 146' located at the clamping end 179'. A tong 134' is pivotally coupled to the male scissor link 130' at the pivot connection 146'. The tong 134' is also pivotally connected to the clamping cylinder 138' at a clamp cylinder pivot mount location 148'. Vise die or gripping members 136' are located approximate each of clamping ends 179' of each link 130', 132' and on the tong 134'.

In this alternative embodiment of the vise mechanism 205', 305', the clamping end 179' of the female scissor link 132' is configured with a retaining structure or extension portion 135. The extension portion couples to the clamping cylinder 138' similar to a tong, at a clamp cylinder pivot mount location 148'. The extension portion 135 includes a heel 137 at which a vise die or gripping member 136' is located. Thereby, the female scissor link 132' includes two vise die or gripping members 136' for contacting and retaining various sized pipes.

It is to be understood that the male scissor links 130, 130' could also be configured with an extension portion in place of a tong for contacting and retaining various sized pipes.

In operation, the clamping process includes, first, retracting the lift cylinder 140 to position the scissors links 130 and 132 in a position that maximizes the vise mechanisms opening. Retraction of the lift cylinder 140 is controlled by a sequence valve (not shown) that senses a pressure spike upon complete retraction of the lift cylinder 140. Other methods of properly sequencing this first step are contemplated. For example, in applications involving various sized drill pipe, the sequencing may be controlled by monitoring the position of the scissor links relative to the surface of the pipe. In the retracted position, the gripping members 136 located on each of the scissors links 130 and 132 are effectively positioned to contact a drill pipe.

Upon proper positioning of the scissors links so that the gripping members 136 of each scissors link is in contact with the drill pipe, the clamping cylinders 138 are extended. Extending the clamping cylinders 138 cause the tong heads 134 to rotate about the tong head pivot connection 146. As the tong heads 134 rotate, the gripping members 136 mounted on the tong heads 134 translate to contact the drill pipe (see FIG. 19*b*). In this clamped position, the four gripping members 136 are spaced at approximately 90 degrees to securely engage the drill pipe. Because of the initial positioning of the scissors links 130 and 132 and operation of the vise mechanisms linkage arrangement, the drill pipe is clamped at locations spaced approximately 90 degree about the diameter of the drill pipe, regardless of size. By contacting the diameter of the drill pipe at approximately evenly space intervals, the clamping force applied to the drill pipe is correspondingly evenly applied about the diameter.

Figure 23:
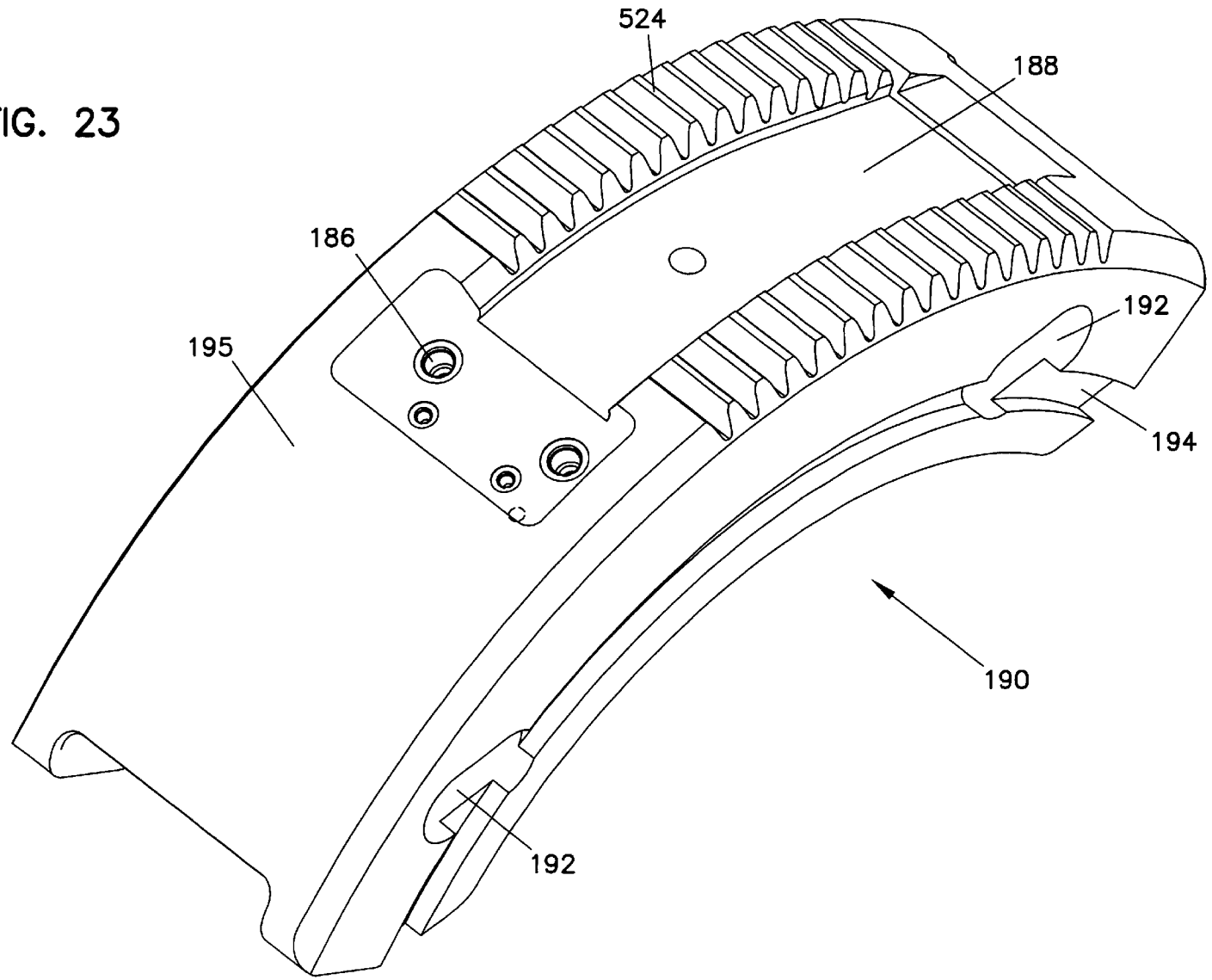
FIG. 23 is a bottom perspective view of the rotary positioner of FIG. 20.

In the preferred embodiment, the lift cylinder 140 and the clamping cylinder 138 of the rotating and fixed vise assemblies 200 and 300 are hydraulically operated. Referring to FIGS. 4, 6, 11, 11A and 23, hydraulic fluid is transported through hydraulic hoses 187 to supply the clamping cylinder 138 with hydraulic power. Hydraulic fluid is also transported through hydraulic hose 185 to supply the lift cylinder 140 with hydraulic power. With respect to the rotating vise assembly 200, a relief 188 is located between the partial gears 524 of the rotary positioner 190 (FIG. 23). Hydraulic fitting ports 186, shown in FIGS. 20 and 23, are located on an exterior surface 195 and an interior surface 197 of the rotary positioner 190 to provide fluid communication through the rotary positioner 190. Hydraulic communication lines 187 and 185 (shown best in FIGS. 11 and 11*a*) can be connected to the hydraulic ports 186 and to lift cylinder 140 and clamping cylinders 138.

Figure 11A:
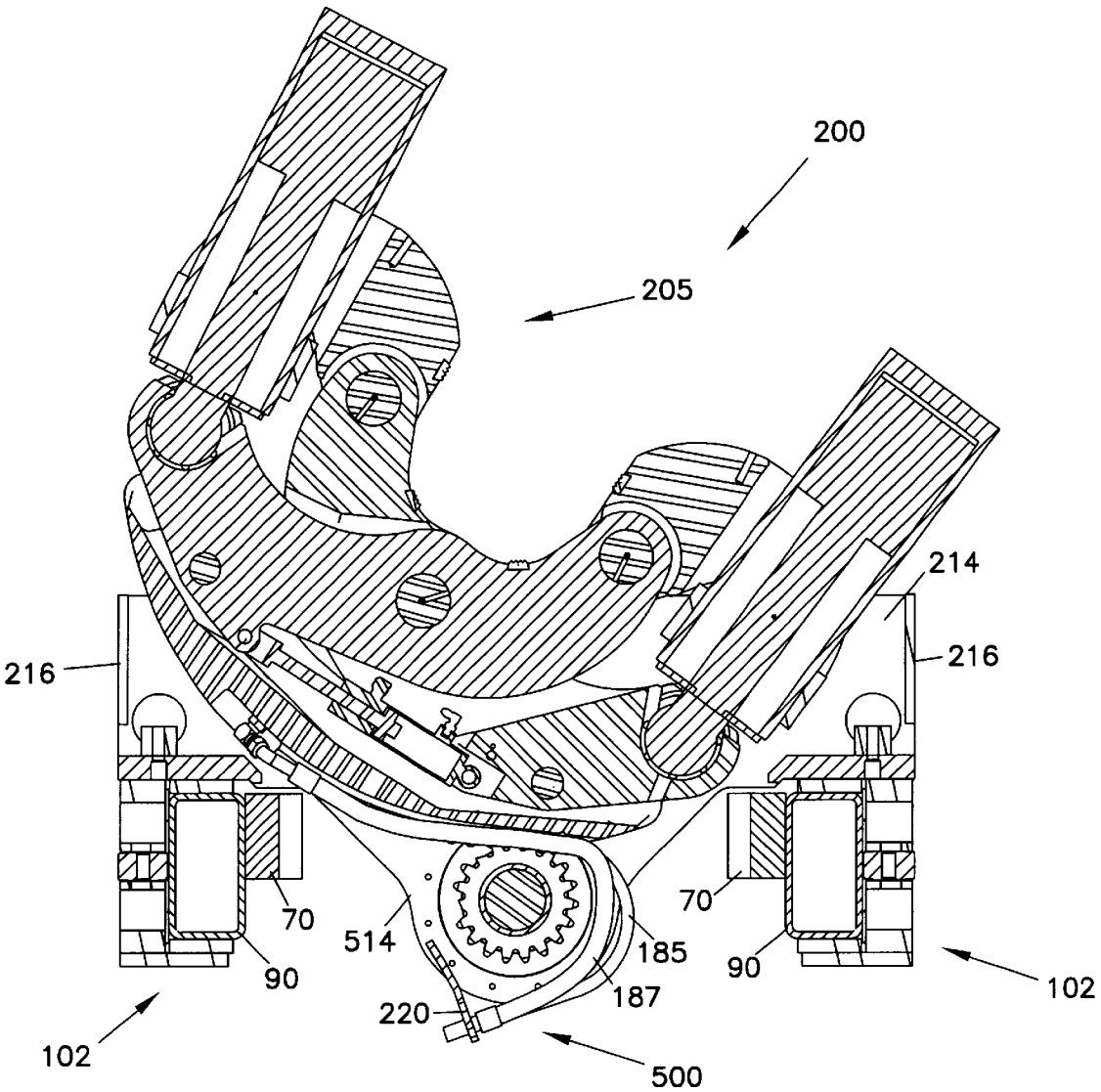
FIG. 11A is a cross-sectional view of the rotating vise assembly taken along line of 11—11 of FIG. 10 shown in a rotated position.

As illustrated in FIGS. 11 and 11A, flexible hydraulic lines 187 are connected to a bulkhead plate 220 that extends from the rotating vise frame 210. The hydraulic lines 187 are routed within a space defined by inner portions of rotational drive gears 516 and the outer periphery of rotational drive shaft 518. The hydraulic lines 187 are further routed through the relief 188 of rotational positioner 190 to connect to hydraulic fitting ports 186. As the rotary positioner 190 is actuated, thereby resulting in angular displacement of the hydraulic ports 186, the hydraulic lines 187 and 185 lie or are maintained within the relief 188 as the rotary positioner 190 rotates through its limits.

In addition to providing sufficient clamping force to a drill pipe, the rotating vise mechanism 205 must provide sufficient torque to uncouple or break-out previously joined drill pipes. Break-out torque is produced by a rotational vise driver assembly 500 shown in FIGS. 10 and 11.

The rotational vise driver assembly 500 includes a hydraulic motor 520 that provides power input to a planetary gearbox 522. The planetary gearbox 522 provides rotational power to a rotational drive shaft 518. A rotational drive gear 516 mounted on the rotational drive shaft 518 mates with a partial gear 524 formed in the rotary positioner 190 (FIG. 20). The partial gear 524 operates to rotate the rotating vise mechanism 205 about the center of the pocket 600 of the vise mechanism 205. The hydraulic motor 520 rotates the rotational drive gear 516 at relatively low speed but with significant torque. The rotational drive gear 516 propels the rotary positioner 190, via the partial gear 524, along an arcuate path defined by the arcuate tab 198. The arcuate tab 198 is substantially concentric with the theoretical centerline of the drill pipe. Thus the rotating vise mechanism 205, coupled to the rotary positioner 190 by the positioning cams 142, rotates to provide break-out torque at a joint between two drill pipes.

Another feature of the present invention involves the capability to position the vise apparatus 100 along the rack assembly 10 as necessary to optimize the drilling process. Optimizing the drilling process requires an arrangement that accommodates variations in the length of drill pipe, for example.

The vise apparatus 100 includes a longitudinal positioner assembly 400 that longitudinally translates the vise apparatus 100 along the rack assembly 10. As shown in FIGS. 2, 12, 14 and 15, the longitudinal positioner assembly 400 mounts to a mount plate 410 attached to the side plate 314 of the fixed vise frame 310. Hydraulic motors 412 are mounted onto the mount plate 410 and coupled to gears 414. The gears 414 mate with the rack gears 70 attached to the rack rails 90. This arrangement permits the vise apparatus 100 to translate longitudinally along the rack rails 90, powered by the hydraulic motors 412. To further optimize the vise apparatus orientation and positioning, the rotating vise assembly 200 can be longitudinally positioned relative to the fixed vise assembly 300 by the separation cylinder 104, as previously disclosed.

The vise apparatus 100 in accordance with the principles of this disclosure have been described primarily in relation to the many benefits associated with the make-up and break-out of drill pipe threaded connections, i.e. the use of a stationary vise assembly and a rotating vise assembly. It is to be understood that the vise apparatus may also consist of a single vise assembly that assists in the make-up and break-out of a drill pipe in conjunction with a rotational driver.

The above specification, examples and data provide a complete description of the manufacture and use of the composition of the invention. Since many embodiments of the invention can be made without departing from the spirit and scope of the invention, the invention resides in the claims hereinafter appended.

I claim:

1. A vise arrangement for use in horizontal drilling, the vise arrangement comprising:

(a) a vise assembly, the vise assembly including:
- (i) a first scissor member;
- (ii) a second scissor member;
  - 1) the first and second scissor members being pivotally connected and defining a pocket;
  - 2) the first scissor member including:
    - a) a first drive end; and
    - b) a first clamp end, the first clamp end having at least a first contact region;
  - 3) the second scissor member including:
    - a) a second drive end; and
    - b) a second clamp end, the second clamp end having a second contact region;
- (iii) a first tong head pivotally connected to the first scissor member, the first tong head having a third contact region.

2. The vise arrangement of claim 1, wherein:

(a) the second clamp end of the second scissor member further includes a fourth contact region.

3. The vise arrangement of claim 1, further including:

(a) a second tong head pivotally connected to the second scissor member, the second tong head having a fourth contact region.

4. A vise arrangement of claim 1, wherein:

(a) each of the first, second, and third contact regions of the first and second scissor members and the first tong head are arranged to contact a pipe positioned within the pocket defined by the first and second scissor members when the first tong head is pivoted from a first position to a second position relative to the first scissor member.

5. A vise arrangement for use in horizontal drilling, the vise arrangement comprising:

(a) a vise assembly, the vise assembly including:
- (i) a first scissor member;
- (ii) a second scissor member;
  - 1) the first and second scissor members being pivotally connected and defining a pocket configured for receipt of various sized pipes;
  - 2) the first and second scissor members each having a pivot end and a drive end, the pivot ends of the first and second scissor members including a first contact region and a second contact region, respectively;
- (iii) a first retaining structure positioned adjacent the pivot end of the first scissor member, the first retaining structure having a third contact region; and
- (iv) a second retaining structure positioned adjacent the pivot end of the second scissor member, the second retaining structure having a fourth contact region.

6. The vise arrangement according to claim 5, wherein:

(a) the first and second retaining structures pivot in correspondence to pivotal movement of the first and second scissor members.

7. The vise arrangement according to claim 5, wherein the vise assembly further includes:

(a) a first drive mechanism that moves the first and second scissor members from an open position to a closed position; and (b) a second drive mechanism pivotally coupled to:
- (i) the drive end of the first scissor member; and
- (ii) the first retaining structure;

(c) a third drive mechanism pivotally coupled to:
- (i) the drive end of the second scissor member; and
- (ii) the second retaining structure;

(d) wherein the second and third drive mechanisms operate to pivot the first and second scissor members, and the corresponding retaining structures, from a first position to a clamped position.

8. The vise arrangement according to claim 5, wherein the vise arrangement includes:

(a) a first vise assembly; and (b) a second vise assembly;
- (i) the first vise assembly operating to retain a first portion of a pipe in a stationary position;
- (ii) the second vise assembly operating to rotate a second portion of the pipe relative to the first portion of pipe.

9. The vise arrangement according to claim 8, further comprising:

(a) a gear operatively connected to the second vise assembly, the gear having a center of rotation approximately coincident with a center of the pocket of the second vise assembly, the gear operating to rotate the second vise assembly about the center of the pocket.

10. The vise arrangement according to claim 9, wherein:

(a) the first vise assembly and the second vise assembly longitudinally translate relative to one another.

11. The vise arrangement according to claim 5, further including (a) a first drive mechanism pivotally connected to the first scissor member and the first retaining structure;

(b) a second drive mechanism pivotally connected to the second scissor member and the second retaining structure; and (c) the first and second drive mechanisms, the first and second scissor members, and the first and second retaining structures cooperating to provide a link arrangement that accommodates various sized pipes while maintaining the contact regions at approximately evenly spaced intervals about each sized pipe.

12. The vise arrangement according to claim 11, wherein the evenly spaced contact regions contact various sized pipes at approximately 90-degree intervals.

13. The vise arrangement according to claim 12, wherein the vise arrangement further includes a gripping member located at each of the first, second, third, and fourth contact regions.

14. A vise arrangement for use in horizontal drilling, the vise arrangement comprising:

(a) a first vise assembly having a first pocket configured to retain a first portion of a pipe in a stationary position;

(b) a second vise assembly having a second pocket configured to retain a second portion of the pipe;

(c) a partial gear connected to the second vise assembly, the partial gear being configured to rotate the second vise assembly about a center of the second pocket to rotate the second portion of the pipe relative to the first portion of the pipe.

15. The vise arrangement of claim 14, further including:

(a) a pinion gear configured to couple with the partial gear, the pinion gear operating to drive the partial gear in at least a first direction.

16. The vise arrangement of claim 14, wherein:

(a) the partial gear is configured to limit rotation of the second vise assembly.

17. A method of clamping a drilling element, the method comprising the steps of:

(a) providing a vise assembly, the vise assembly including:

(i) a scissors linkage having:

(A) a first scissor member pivotally moveable relative to a second scissor member, the first and second scissor members defining a pocket; and (B) a first clamping member pivotally moveable relative to the first scissor member;

(b) placing the drilling element within the pocket;

(c) pivoting the first and second scissor members to close the pocket about the drilling element;

(d) pivoting the first clamping member relative to the first scissor member to clamp the pipe within the pocket.

18. The method of claim 17, further including:

(a) adjusting the pocket of the scissors linkage to accommodate a selected size of a drilling element.

19. The method of claim 18, wherein:

(a) the step of adjusting the pocket includes actuating a positioning cylinder pivotally connected to the first and second scissor members.

20. The method of claim 17, wherein the step of pivoting the first clamping member includes:

(a) actuating a first clamping mechanism, the first clamping mechanism being pivotally connected to the first scissor member and the first clamping member.

21. The method of claim 17, further including:

(a) contacting the drilling element at approximately evenly spaced intervals to apply evenly distributed clamping force.

* * * * *